US010771891B2

(12) United States Patent
Hong et al.

(10) Patent No.: US 10,771,891 B2
(45) Date of Patent: Sep. 8, 2020

(54) METHOD FOR MANUFACTURING AIR PULSE GENERATING ELEMENT

(71) Applicant: xMEMS Labs, Inc., Los Altos, CA (US)

(72) Inventors: David Hong, Los Altos, CA (US); Chiung C. Lo, San Jose, CA (US); Chun-I Chang, Hsinchu County (TW)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

(21) Appl. No.: 16/380,988

(22) Filed: Apr. 10, 2019

(65) Prior Publication Data

US 2020/0059721 A1 Feb. 20, 2020

Related U.S. Application Data

(60) Provisional application No. 62/719,694, filed on Aug. 19, 2018, provisional application No. 62/726,319, (Continued)

(51) Int. Cl.
*H04R 1/32* (2006.01)
*H04R 17/00* (2006.01)
(Continued)

(52) U.S. Cl.
CPC ..... *H04R 1/323* (2013.01); *G10K 9/12* (2013.01); *H04R 17/005* (2013.01); (Continued)

(58) Field of Classification Search
CPC ..... H04R 2201/003; H04R 17/00; H04R 19/005; B81C 1/00166; B81C 1/00047; B81C 1/00071; B81C 1/00063
See application file for complete search history.

(56) References Cited

U.S. PATENT DOCUMENTS 10,327,060 B2 6/2019 Lo
2010/0188935 A1 7/2010 Qian
(Continued)

FOREIGN PATENT DOCUMENTS

CN 101783994 A 7/2010
CN 102378094 A 3/2012
(Continued)

OTHER PUBLICATIONS

Lo, Title of Invention: Air Pulse Generating Element and Sound Producing Device, U.S. Appl. No. 16/172,876, filed Oct. 29, 2018.
(Continued)

*Primary Examiner* — Sunita Joshi
(74) *Attorney, Agent, or Firm* — Winston Hsu

(57) ABSTRACT

A method for manufacturing an air pulse generating element is provided. First, a thin film layer including a membrane is provided, and then, a plurality of actuators are formed on the thin film layer. After that, a first chamber is formed between the thin film layer and a first plate and followed by patterning the thin film layer to form a plurality of valves, in which the membrane and the valves are formed of the thin film layer. Subsequently, a second chamber is formed between the thin film layer and a second plate, and a plurality of channels are formed in the first plate and the second plate.

19 Claims, 35 Drawing Sheets

Related U.S. Application Data filed on Sep. 3, 2018, provisional application No. 62/726,400, filed on Sep. 3, 2018.

(51) Int. Cl.

| | |
|---|---|
| ***H04R 19/00*** | (2006.01) |
| ***H04R 19/02*** | (2006.01) |
| ***H04R 9/06*** | (2006.01) |
| ***G10K 9/12*** | (2006.01) |

(52) U.S. Cl.

CPC ..... *H04R 19/005* (2013.01); *H04R 19/02* (2013.01); *H04R 9/063* (2013.01)

(56) References Cited

U.S. PATENT DOCUMENTS

| | | | | |
|---|---|---|---|---|
| 2013/0136280 | A1 | 5/2013 | Stephanou | |
| 2013/0223023 | A1 | 8/2013 | Dehe | |
| 2015/0230029 | A1 | 8/2015 | Hong | |
| 2015/0381078 | A1 | 12/2015 | Massoner | |
| 2016/0381464 | A1 | 12/2016 | Elyada | |
| 2017/0201192 | A1 * | 7/2017 | Tumpold | ..... H01L 41/0973 |

FOREIGN PATENT DOCUMENTS

| | | | | |
|---|---|---|---|---|
| GB | 2483337 | A | 3/2012 | |
| WO | 2013/049794 | A1 | 4/2013 | |
| WO | 2016/107975 | A1 | 7/2016 | |
| WO | WO-2016107975 | A1 * | 7/2016 | ..... H04R 17/00 |
| WO | 2016202790 | A2 | 12/2016 | |

OTHER PUBLICATIONS

Hong, Title of Invention: Air Pulse Generating Element and Sound Producing Device, U.S. Appl. No. 16/379,746, dated Apr. 9, 2019.

* cited by examiner

METHOD FOR MANUFACTURING AIR PULSE GENERATING ELEMENT

CROSS REFERENCE TO RELATED APPLICATIONS

This application claims benefit of U.S. Provisional Patent Application No. 62/719,694, filed Aug. 19, 2018, U.S. Provisional Patent Application No. 62/726,319, filed Sep. 3, 2018 and U.S. Provisional Patent Application No. 62/726,400, filed Sep. 3, 2018, the entire contents of which are incorporated herein by reference.

BACKGROUND OF THE INVENTION

1. Field of the Invention

The present application relates to a method for manufacturing an air pulse generating element, and more particularly, to a method for manufacturing an air pulse generating element with low manufacturing complexity and high yield rate.

2. Description of the Prior Art

A speaker driver and a back enclosure are two major design challenges in the speaker industry. It is difficult for a conventional speaker driver to cover an entire audio frequency band, e.g., from 20 Hz to 20 KHz, due to a membrane displacement D is proportional to $1/f^2$, i.e., $D \propto 1/f^2$. On the other hand, to produce sound with high fidelity, a volume/size of back enclosure for the conventional speaker is required to be sufficiently large.

To combat against the design challenges in the above, applicant has proposed an air pulse generating element and a sound producing device in U.S. application Ser. No. 16/125,761, which produce sound using a plurality of pulses at a pulse rate, where the pulse rate is higher than a maximum audible frequency and the plurality of pulses is regarded as being amplitude modulated according to an input audio signal. By exploiting a low pass effect caused by ambient environment and human ear structure, a sound corresponding to the input audio signal is perceived. The sound producing device in U.S. application Ser. No. 16/125,761 is able to cover the entire audio frequency band, and an enclosure volume/size of which is significantly reduced.

However, the air pulse generating element in U.S. application Ser. No. 16/125,761 is complicated to be manufactured, because it requires 3 different layers to manufacture the valves and the membrane thereof, suffering from low yield rate. Therefore, it is necessary to lower the manufacturing complexity of the air generating element.

SUMMARY OF THE INVENTION

It is therefore an objective of the present invention to provide a method for manufacturing an air pulse generating element to lower manufacturing complexity and increase yield rate.

According to an embodiment, a method for manufacturing an air pulse generating element is disclosed. The method includes providing a thin film layer including a membrane; forming a plurality of actuators on the thin film layer; forming a first chamber between the thin film layer and a first plate; patterning the thin film layer to form a plurality of valves, in which the membrane and the valves are formed of the thin film layer; forming a second chamber between the thin film layer and a second plate; and forming a plurality of channels in the first plate and the second plate.

In the method for manufacturing the air pulse generating element of the present invention, the valves and the membrane are formed of the same thin film layer, and the actuators are formed on the same surface of the thin film layer, so the manufacturing complexity is lowered, and the yield rate is improved.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
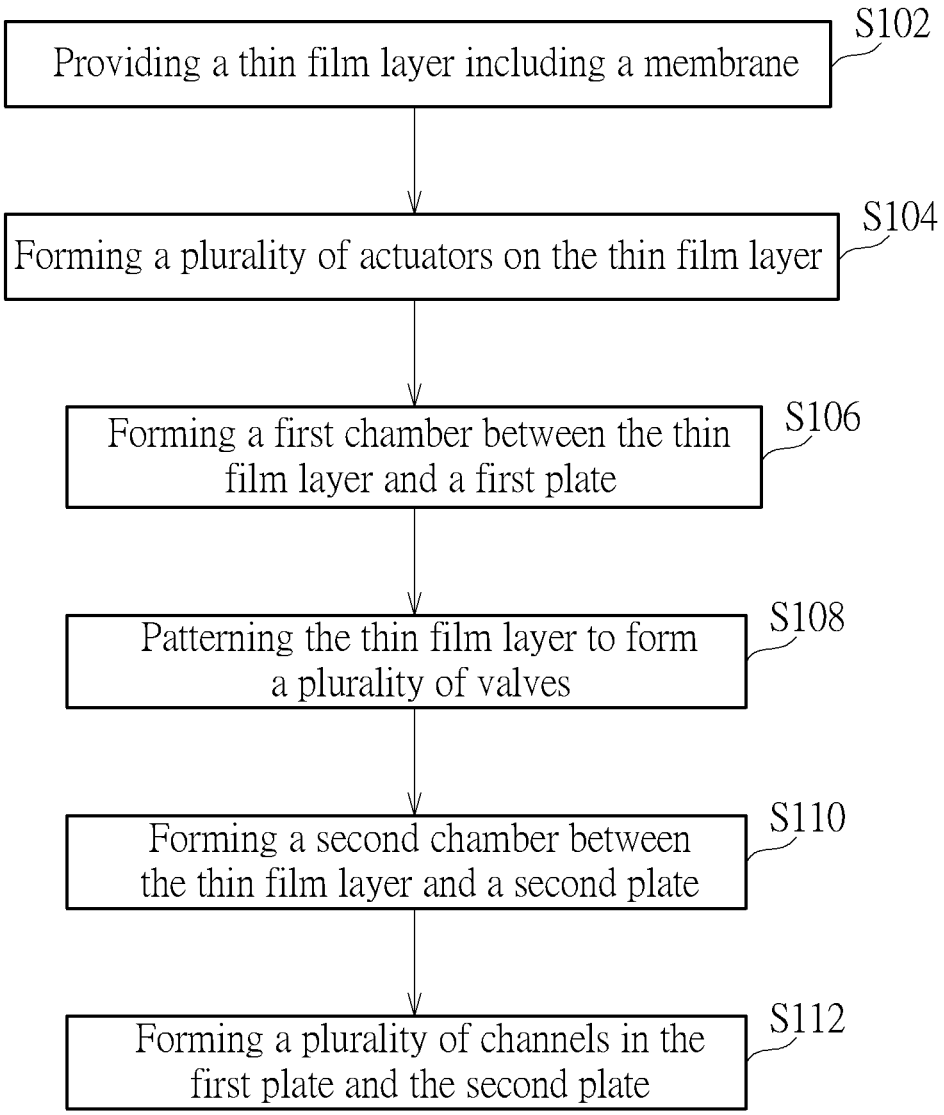
FIG. 1 is a flowchart of a method for manufacturing an air pulse generating element according to a first embodiment of the present invention.

To provide a better understanding of the present invention to those skilled in the art, preferred embodiments will be detailed in the follow description. The preferred embodiments of the present invention are illustrated in the accompanying drawings with numbered elements to elaborate on the contents and effects to be achieved. It should be noted that the drawings are simplified schematics, and therefore show only the components and combinations associated with the present invention, so as to provide a clearer description for the basic structure or implementing method of the present invention. The components would be more complex in reality. In addition, for ease of description, the components shown in the drawings may not represent their actual number, shape, and dimensions; details may be adjusted according to design requirements.

FIG. 1 is a flowchart of a method for manufacturing an air pulse generating element according to a first embodiment of the present invention, and FIG. 2 to FIG. 11 schematically illustrate structures at different stages of the method for manufacturing the air pulse generating element according to the first embodiment of the present invention. As shown in FIG. 1, the method for manufacturing the air pulse generating element includes the following steps S102, S104, S106, S108, S110, S112 and is detailed in the following description combined with FIG. 2 to FIG. 11.

Figure 2:
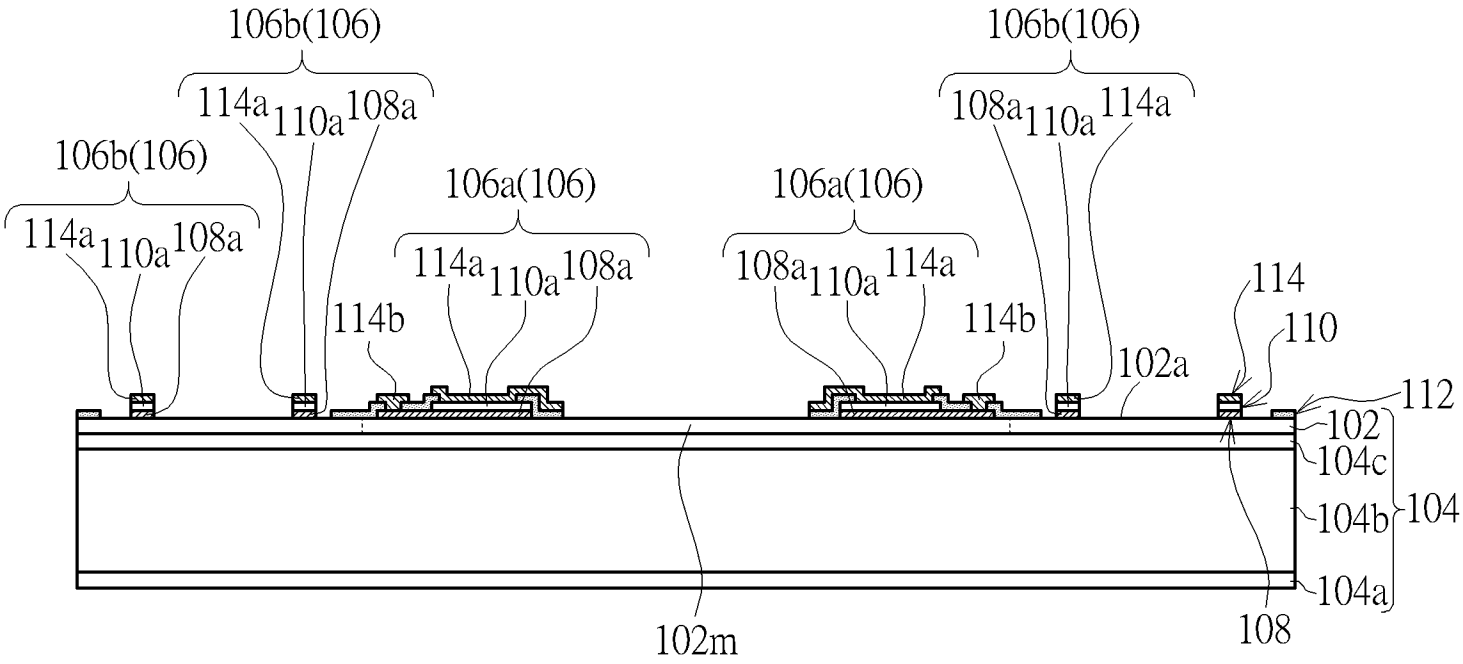
FIG. 2 to FIG. 11 schematically illustrate structures at different stages of the method for manufacturing the air pulse generating element according to the first embodiment of the present invention.

As shown in FIG. 1 and FIG. 2, in step S102, a thin film layer 102 is provided. Specifically, a substrate 104 is provided firstly, and the thin film layer 102 may be a portion of the substrate 104. In this embodiment, the thin film layer 102 may include at least one membrane 102*m*, i.e. at least one portion of the thin film layer 102 may serve as the membrane 102*m* for generating air pulses through the oscillation of the membrane 102*m*. In one embodiment, besides the thin film layer 102, the substrate 104 may further include a protection layer 104*a*, a support substrate 104*b*, another protection layer 104*c* and the thin film layer 102 sequentially stacked. The protection layers 104*a*, 104*c* respectively include any suitable insulating material for providing proper insulation between the support substrate 104*b* and the thin film layer 102. For example, the protection layers 104*a*, 104*c* may respectively include silicon oxide, silicon nitride or silicon oxynitride. The support substrate 104*b* include any suitable material for supporting components or layers formed thereon, and the thin film layer 102 include any suitable semiconductor material for being capable of oscillation. For example, the substrate 104 may be silicon on insulator (SOI) or germanium on insulator (GOI), and the support substrate 104*b* and the thin film layer 102 respectively include silicon or germanium, but not limited thereto. Alternatively, the support substrate 104*b* and the thin film layer 102 may include silicon germanium, silicon carbide, glass, gallium nitride, gallium arsenide, and/or other suitable III-V compound. In some embodiments, the thin film layer 102 may be formed of heavily doped semiconductor layer, such as heavily boron doped silicon or n-type silicon of PN junction, as an etch-stop layer which has a lower etching rate than typical p-type substrate. The thickness of the thin film layer 102 may for example be 5 μm.

In step S104, after the thin film layer 102 is provided, a plurality of actuators 106 are formed on the thin film layer 102. Specifically, the step of forming the actuators 106 includes depositing a bottom conductive layer 108 on a first surface 102*a* of the thin film layer 102, patterning the bottom conductive layer 108, depositing a deformable layer 110 on the bottom conductive layer 108, patterning the deformable layer 110, depositing an insulation layer 112 on the deformable layer 110, patterning the insulation layer 112, depositing a top conductive layer 114 on the deformable layer 110, and patterning the top conductive layer 114. In one embodiment, the deposition of the bottom conductive layer 108, the patterning of the bottom conductive layer 108, the deposition of the deformable layer 110 and the patterning of the deformable layer 110 may be performed in sequence. In some embodiments, the deposition of the deformable layer 110 and the patterning of the deformable layer 110 may be sequentially performed between the deposition of the bottom conductive layer 108 and the patterning of the bottom conductive layer 108. The bottom conductive layer 108 and the top conductive layer 114 respectively include conductive material for controlling the deformation of the deformable layer 110, preferably include conductive material with better elasticity, such as metal. For example, the metal may include platinum (Pt) or gold (Au), but not limited thereto. In some embodiments, the bottom conductive layer 108 and the top conductive layer 114 may be formed of the same material or different materials. The deformable layer 110 may be deformed by a piezoelectric force, an electrostatic force, an electromagnetic force or an electrothermal force and includes suitable material based on the deforming force. For example, the deformable layer 110 of this embodiment is deformed by a piezoelectric force and may include PZT (lead zirconate titanate) or AlScN (scandium doped aluminum nitride), but not limited thereto. The insulation layer 112 includes suitable insulating material for providing electrical insulations between the bottom conductive layer 108 and the top conductive layer 114 and between the top conductive layer 114 and the thin film layer 102 of the substrate 104. For example, the insulation layer 112 may include silicon oxide, silicon nitride or silicon oxynitride. In the present invention, the step of "patterning" used herein may be referred to as performing a photolithography and etching process using a photomask or performing an etching process by using a patterned layer as a mask.

In one embodiment, the step of patterning the bottom conductive layer 108 may form a plurality of first electrodes 108*a*; the step of patterning the deformable layer 110 may form a plurality of deformable blocks 110*a*; the step of patterning the insulation layer 112 may form a plurality of openings 112*a* in the insulation layer 112; and the step of patterning the top conductive layer 114 may form a plurality of second electrodes 114*a*. Each of the first electrodes 108*a*, each of the deformable blocks 110*a* and each of the second electrodes 114*a* may form one of the actuators 106. In one of the actuators 106, the first electrode 108*a*, the deformable block 110*a* and the second electrode 114*a* may be sequentially stacked on the first surface 102*a* of the thin film layer 102 and form a sandwich structure. The step of forming the actuators 106 may include forming a membrane actuator 106*a* on the membrane 102*m* and forming a plurality of valve actuators 106*b* on portions of the thin film layer 102 to be formed as valves. In other words, the first electrodes 108*a* of the membrane actuator 106*a* and the valve actuators 106*b* are formed of the same bottom conductive layer 108, the deformable blocks 110*a* of membrane actuator 106*a* and the valve actuators 106*b* are formed of the same deformable layer 110, and the second electrodes 114*a* of membrane actuator 106*a* and the valve actuators 106*b* are formed of the same top conductive layer 114, so the membrane actuator 106*a* and the valve actuators 106*b* can be formed at the same time.

In some embodiments, in order to electrically connect one of the actuators 106 to the devices outside the air pulse generating element or electrically connect different actuators 106 to each other, the step of patterning the top conductive layer 114 may further form traces 114*b* separated from each other. For example, one of the traces 114*b* may be electrically connected to one of the first electrodes 108*a* through one of the opening 112*a*, and another one of the traces 114*b* may be connected to one of the second electrodes 114*a*. Also, for providing insulation, the insulation layer 112 is disposed between the traces 114*b* and the substrate 104 and between the trace 114*b* connected to the second electrode 114*a* and a sidewall of the first electrode 108*a*. In some embodiments, the step of patterning the top conductive layer 114 may further form bonding pads (not shown in FIG. 2 to FIG. 11) for being connected to outside electronics, such as wire bonding pads or flip chip bonding pads. Since the insulation layer 112 is formed after the deformable layer 110, in order not to affect the properties of the deformable layer 110 (for example for PZT material), the insulation layer 112 may be deposited at a temperature lower than or equal to 400° C. For example, the insulation layer 112 is preferably formed by plasma enhanced chemical vapor deposition (PECVD) or atomic layer deposition (ALD).

Figure 3:
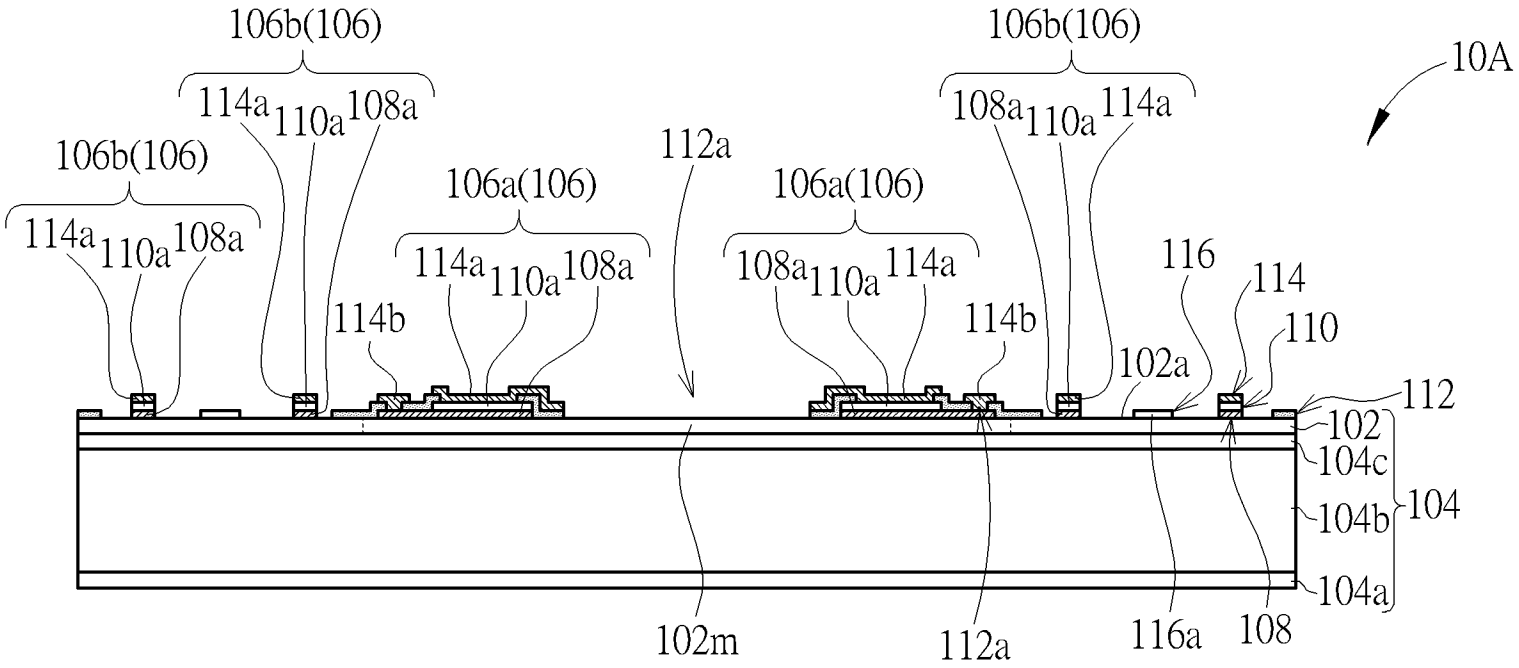

As shown in FIG. 3, after the actuators 106 are formed, another insulation layer 116 is deposited on the actuators 106 and the traces 114*b* and followed by patterning the insulation layer 116, thereby forming a structure 10A. In one embodiment, the patterned insulation layer 116 may cover the patterned top conductive layer 114 for protecting the actuators 106, the traces 114*b* and the bonding pads during forming channels in a first plate 20A and a second plate 30 mentioned below. For clarity, FIG. 3 doesn't show the patterned insulation layer 116 covers the patterned top conductive layer 114, but not limited thereto. In one embodiment, the step of patterning the insulation layer 116 may form a plurality of insulation blocks 116*a*, in which the insulation block 116*a* may be disposed on a portion of the thin film layer 102 that is to be formed as valve, so as to serve as an etching stop layer for protecting the valve during etching processes in the subsequent steps. The insulation layer 116 may for example include silicon oxide, silicon nitride or silicon oxynitride. Also, since the insulation layer 116 is formed after the deformable layer 110, in order not to affect the properties of the deformable layer 110 (for example for PZT material), the insulation layer 116 may be deposited at a temperature lower than or equal to 400° C. For example, the insulation layer 116 is preferably formed by plasma enhanced chemical vapor deposition (PECVD) or atomic layer deposition (ALD).

Figure 12:
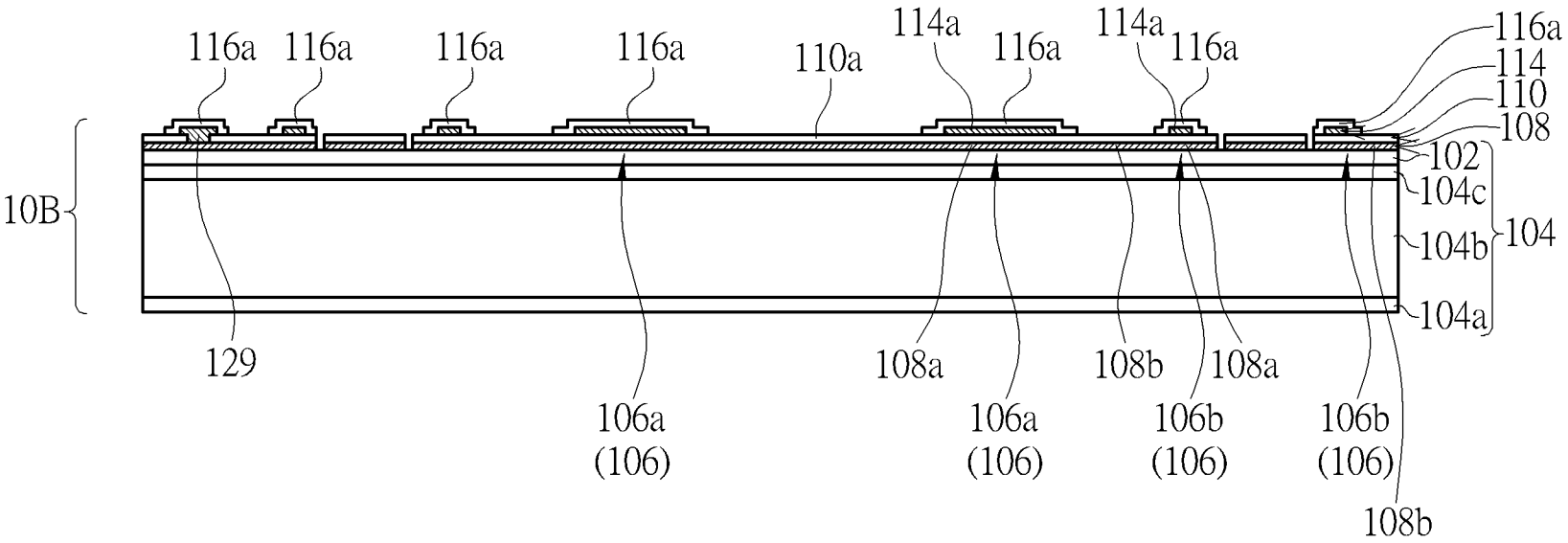
FIG. 12 schematically illustrate a structure that the deformable layer and the bottom conductive layer are patterned by using the same photomask according to some embodiments of the present invention.

As shown in FIG. 12, in some embodiments, the deformable layer 110 and the bottom conductive layer 108 may be patterned by using the same photomask, so most of the patterned deformable layer 110 may have the same pattern as most of the bottom conductive layer 108. Since that, the deformable blocks 110*a* after patterning may be used for electrical isolating the patterned bottom conductive layer 108 and the patterned top conductive layer 114. For example, the patterned bottom conductive layer 108 may include traces 108*b* for electrically connecting each bottom electrode 108*a* to the bonding pad 129. After the top conductive layer 114 is patterned, the insulation layer 116 is deposited on the actuators 106 and the patterned top conductive layer 114 and followed by patterning the insulation layer 116, thereby forming the structure 10B. Because the deformable blocks 110*a* electrical insulates the patterned bottom conductive layer 108 from the patterned top conductive layer 114 in the first chamber formed in the following step (e.g. insulates the bottom electrodes 108*a* from the top electrode 114*a*), the presence of the insulation layer 112 in the above embodiment is not required and can be eliminated, and the step of patterning the insulation layer 112 also can be eliminated, thereby simplifying the process steps and saving the cost. In such case, most of the patterned deformable layer 110 for electrical isolating the patterned bottom conductive layer 108 and the patterned top conductive layer 114 are kept. For example, the deformable blocks 110*a* may have the same pattern as the patterned bottom conductive layer 108 in the first chamber. Also, the patterned deformable layer 110 outside the first chamber may be patterned to expose the traces 108*b*, and a portion of the patterned top conductive layer 114 used as a bonding pad 129 may penetrate through the patterned deformable layer 110 to be electrically connected to one of the traces 108*b*. In the following steps for forming the air pulse generating element 100, the structure 10A may be replaced by the structure 10B and will not be narrated herein for brevity.

A first plate 20A and a second plate 30 may be provided. Since the formation of the first plate 20A and the formation of the second plate 30 doesn't affect the formation of the actuators 106 and the insulation layer 116, so the formation of the first plate 20A and the formation of the second plate 30 may be performed before, after or at the same time as the formation of the actuators 106 and the insulation layer 116. Since the steps and sequence of the method for forming the first plate 20A are the same as the steps and sequence of the method for forming the second plate 30, the method for forming the first plate 20A is taken for an example in the following description, and the method for forming the second plate 30 is not narrated herein for brevity.

Figure 4:
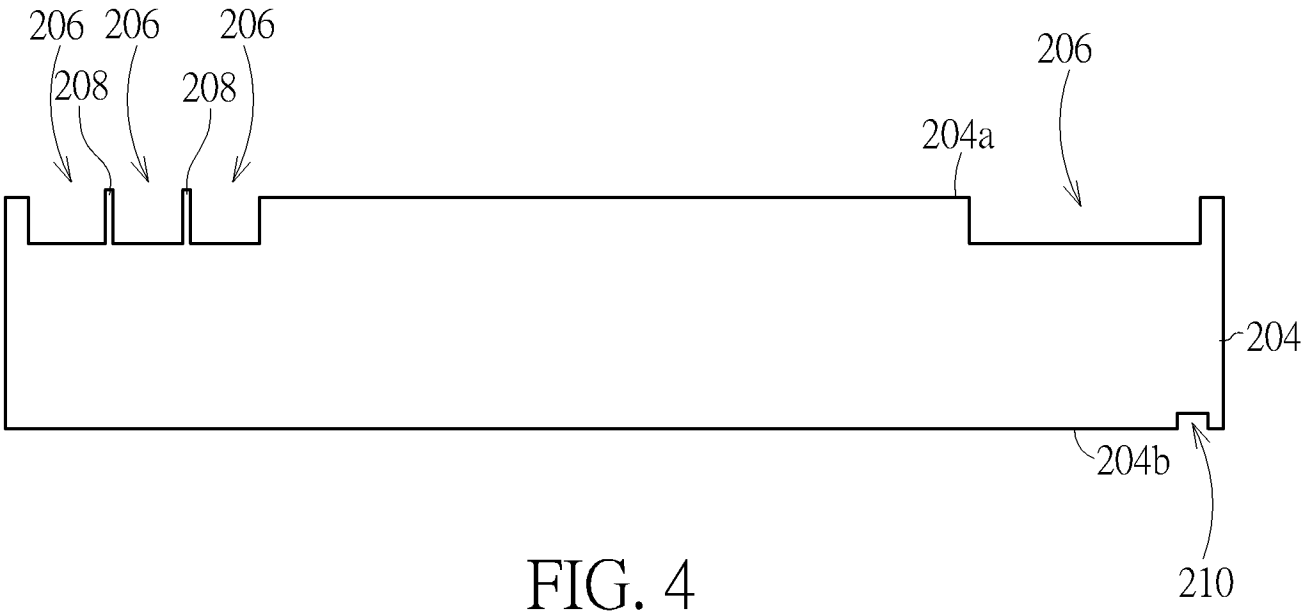
Figure 5:
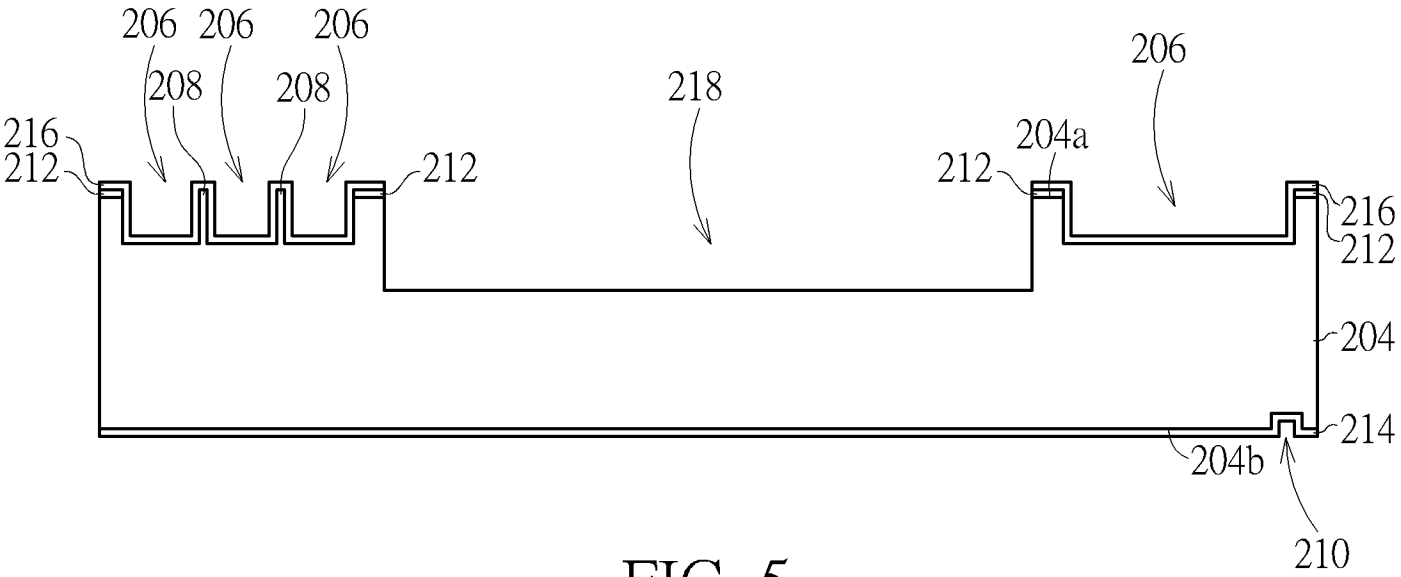
Figure 6:
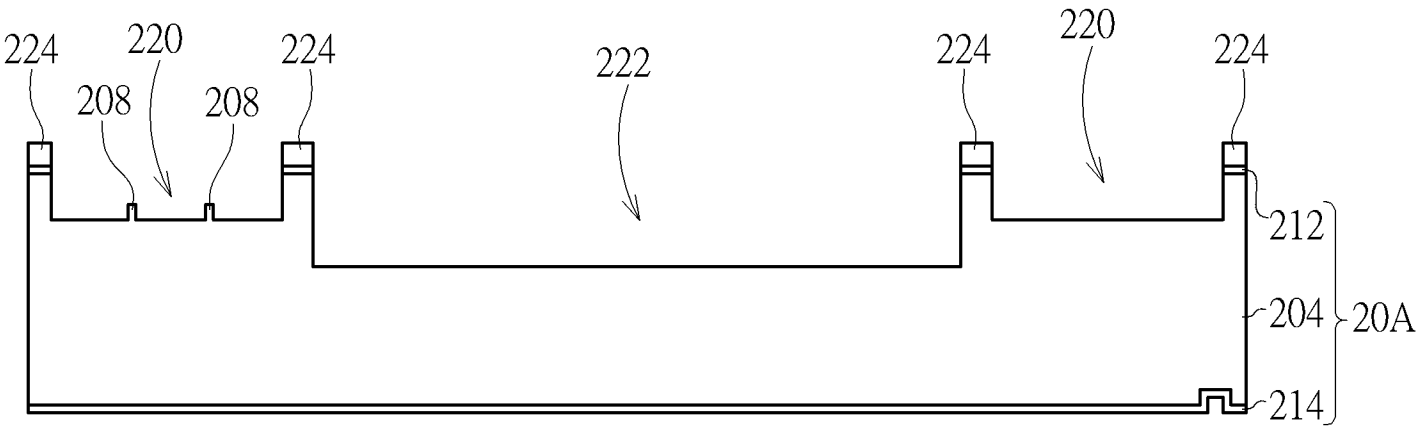

FIG. 4 to FIG. 6 schematically illustrates a method for forming the first plate. As shown in FIG. 4, a substrate 204 is provided firstly, and then, a photolithographic and etching process is performed to form a plurality of recesses 206 on a surface 204*a* of the substrate 204. In some embodiments, the step of forming the recesses 206 may further include forming a protrusion 208 surrounding one of the recesses 206, in which the protrusion 208 and the surrounded recess 206 may be also called a dimple structure for reducing a contact area between the valve and the first plate 20A during operating the air pulse generating element. After that, an alignment mark 210 may be formed on another surface 204*b* of the substrate 204 opposite to the surface 204*a*, such that the position of the recesses 206 may be obtained when the first plate 20A is bonded on the thin film layer 102. In this embodiment, the alignment mark 210 may be a recess, but not limited thereto. In some embodiments, the alignment mark 210 may be formed before forming the recesses 206. The substrate 204 may include a semiconductor substrate, for example be a blank semiconductor wafer, such as silicon wafer, silicon germanium wafer, germanium wafer, and/or another suitable III-V compound wafer.

As shown in FIG. 5, subsequently, an etching stop layer 212 is conformally formed on the surface 204*a* and the sidewalls and the bottoms of the recesses 206 and an etching stop layer 214 is formed on the surface 204*b* and sidewalls and the bottom of the alignment mark 210. In some embodiments, the etching stop layers 212, 214 may be formed by a thermal oxidation process, so the etching stop layers 212, 214 may be formed at the same time, but not limited thereto. After that, the etching stop layer 212 on the surface 204*a* is patterned to expose the surface 204*a* of the substrate 204 and the recesses 206 and the protrusion 208, and then, a photoresist pattern 216 is formed to cover the patterned etching stop layer 212 and the recesses 206 and the protrusion 208 by a developing and etching process. Thereafter, an etching process using the photoresist pattern 216 as a mask is performed on the substrate 204 to form a recess 218 on the surface 204*a*. In one embodiment, the recess 218 may have different depths from the recesses 206. The etching stop layers 212, 214 may for example include silicon oxide or silicon nitride.

As shown in FIG. 6, the photoresist pattern 216 is removed to expose the recesses 206 and optionally followed by performing an etching process using the patterned etching stop layer 212 as a mask to etching the exposed recesses 206, 218, so as to form at least two recesses 220, 222 with different depths. Accordingly, the first plate 20A is formed, in which the protrusion 208 is located in the recess 220, and the depth of the recess 220 is greater than a height of the protrusion 208, so when the first plate 20A is bonded on the thin film layer 102, a spacing exists between the thin film layer 102 and the protrusion 208. In one embodiment, the recess 222 corresponds to the membrane, and the recesses 220 respectively correspond to the valves, so the depth of the recess 222 may be greater than the depths of the recesses 220. Also, the recesses 220 may be connected to the recess 222.

In some embodiments, the etching stop layer 212 on the surface 204*a* may be patterned to expose the recesses 206 and the protrusion 208 and then be used as a mask to form the recesses 220 before forming the photoresist pattern 216. In such situation, after the photoresist pattern 216 that covers the recesses 220 is formed, the photoresist pattern 216 may be used as a mask to pattern the patterned etching stop layer 212 and the substrate 204 to form the recess 222, so the recesses 220 and the recess 222 may not be formed at the same time. The formation of the recesses 220, 222 are not limited herein.

In some embodiments, after the first plate 20A is formed, a first bonding agent 224 may be formed on the first plate 20A before bonding the first plate 20A on the structure 10A, and then, the first bonding agent 224 is patterned to expose the recesses 220, 222. The first bonding agent 224 is used for bonding the first plate 20A on the structure 10A. When the first bonding agent 224 includes the photoresist material, the step of patterning the first bonding agent 224 may be performed by utilizing a developing and etching process. In some embodiments, the first bonding agent 224 may be formed on the surface 204*a* of the first plate 20A before etching the recess 218, for example before patterning the etching stop layer 212. Since the first bonding agent 224 includes photoresist material, the first bonding agent 224 may be then patterned by a developing process to be used as a mask for patterning the etching stop layer 212 and then forming the recess 218. Also, the first bonding agent 224 may be further patterned by another developing process to be used as a mask to pattern the patterned etching stop layer 212, and thus, the patterned first bonding agent 224 can have the same pattern as the patterned etching stop layer 212. After that, the recesses 220, 222 may be formed by using the patterned first bonding agent 224 as the mask. In such situation, the photoresist pattern 216 may be eliminated and one photomask for patterning the etching stop layer 212 may be eliminated, thereby simplifying the process steps and saving the cost.

Figure 7:
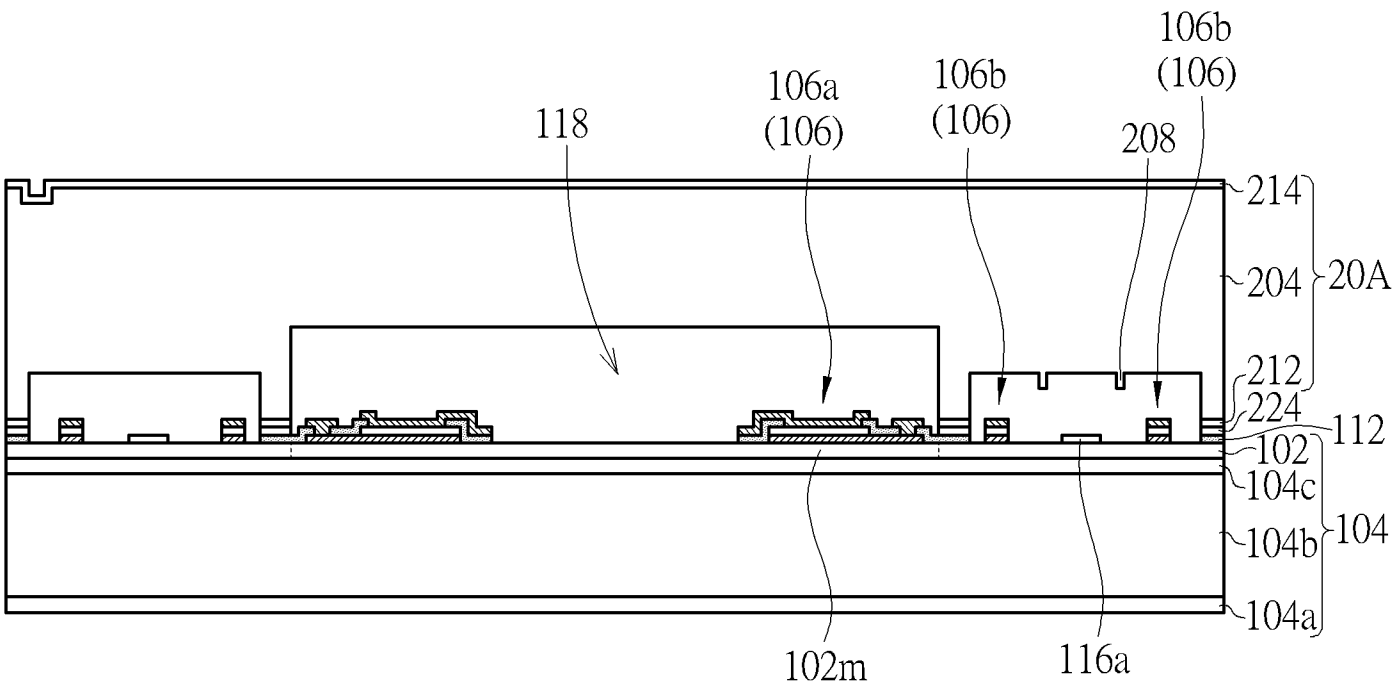

As shown in FIG. 1 and FIG. 7, in step S106, after the structure 10A and the first plate 20A are formed, a first chamber 118 is formed between the first surface 102*a* of the thin film layer 102 and the first plate 20A. Specifically, the first chamber 118 is formed by bonding the first plate 20A on the insulation layer 112 or the insulation layer 116 on the first surface 102*a* of the thin film layer 102 through the first bonding agent 224, and the first plate 20A may be bonded at a temperature for example lower than 400° C. The bonding between the substrate 10A and the first plate 20A may for example use dry film, spin on glass (SOG), eutectic bonding, photoresist, thermal compression, low-temperature fusion or other suitable bonding method. For example, the first bonding agent 224 may include polymer material, glass frit, metal eutectic or other suitable material, but not limited thereto. The first bonding agent 224 including the polymer material may for example include dry film, Benzocyclobutene (BCB), SU-8, polyimide or epoxy, in which SU-8 and the dry film may include negative photoresist material. It is noted that since the first bonding agent 224 can form strong bonding forces with the first plate 20A and the structure 10A at a low temperature, such as 400° C., which reduces thermal stress on the thin film layer 102 and actuators 106 and avoids the bonding temperature affecting or damaging the deformable blocks 110*a* of the actuators 106, the use of the first bonding agent 224 is preferable to other method. Also, because of including polymer material, the first bonding agent 224 may release the thermal stress between the thin film layer 102 and the first plate 20A during high temperature process or high temperature operating environment, thereby preventing the thin film layer 102 from warpage. Accordingly, the effect of the thermal stress to the final air pulse generating element can be reduced, and the difference between the coefficients of thermal expansion of the thin film layer 102 and the first plate 20A may be increased, i.e. the material of the first plate 20A is not limited to the semiconductor material. Since the recesses 220 are connected to the recess 222, the first chamber 118 may be enclosed by the recesses 220, recess 222 and the thin film layer 102. In some embodiments, a region of the first bonding agent 224 contacting the structure 10A may have slots or openings, so the first bonding agent 224 can release its stress on the thin film layer 102 during bonding.

Figure 8:
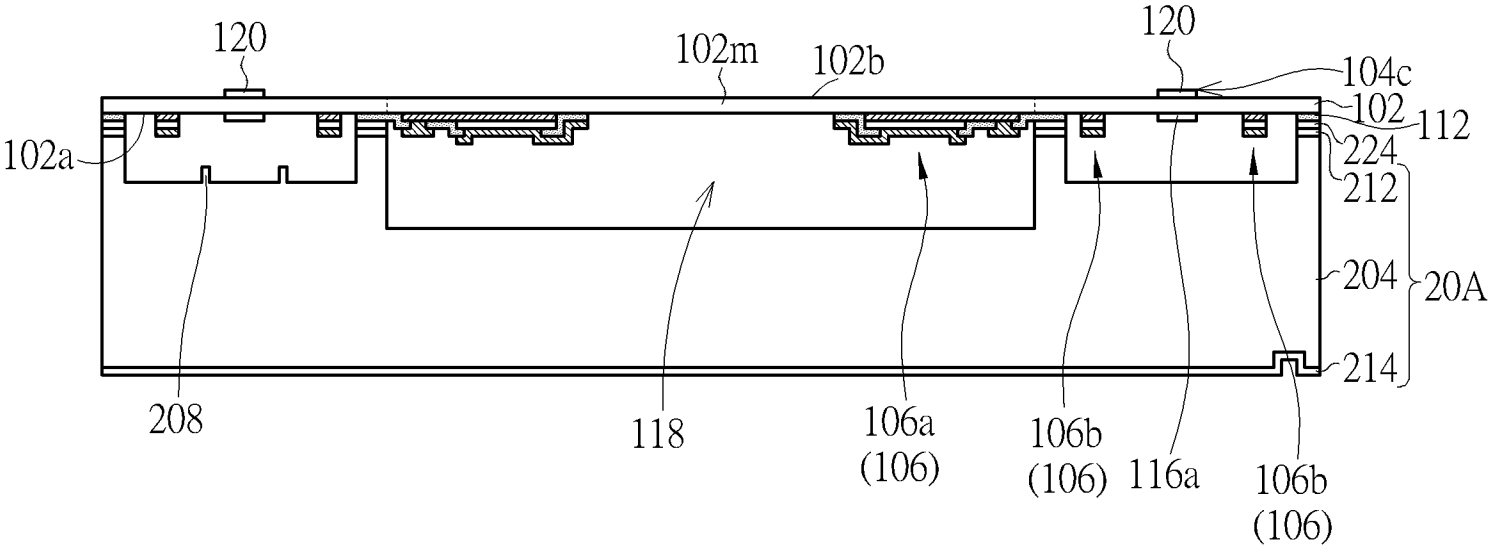

As shown in FIG. 8, after the first chamber 118 is formed, the bonded structure of the first plate 20A and the structure 10A is flipped over, and then, the protection layer 104*a* and the support substrate 104*b* are removed to expose the protection layer 104*c*, for example by wafer grinding or in combination with etching process. After that, the protection layer 104*c* may be optionally thinned, for example by wet etching process or dry etching process. The thickness of the protection layer 104*c* may be thinned to be for example in a range from 0.1 μm to 2 μm. Subsequently, the protection layer 104*c* is patterned to form a plurality of protection blocks 120 and expose the thin film layer 102. Each of the protection blocks 120 is located on one of the valves to be formed and corresponds to one of the insulation blocks 116 respectively, and the protection block 120 and the corresponding insulation block 116*a* can be disposed on two opposite surfaces 102*a*, 102*b* of the corresponding valve, so the corresponding valve between the protection block 120 and the corresponding insulation block 116*a* can have similar or the same stress on the two opposite surfaces 102*a*,

102*b*, which reduces bend of the corresponding valve and makes the corresponding valve as flat as possible.

Figure 9:
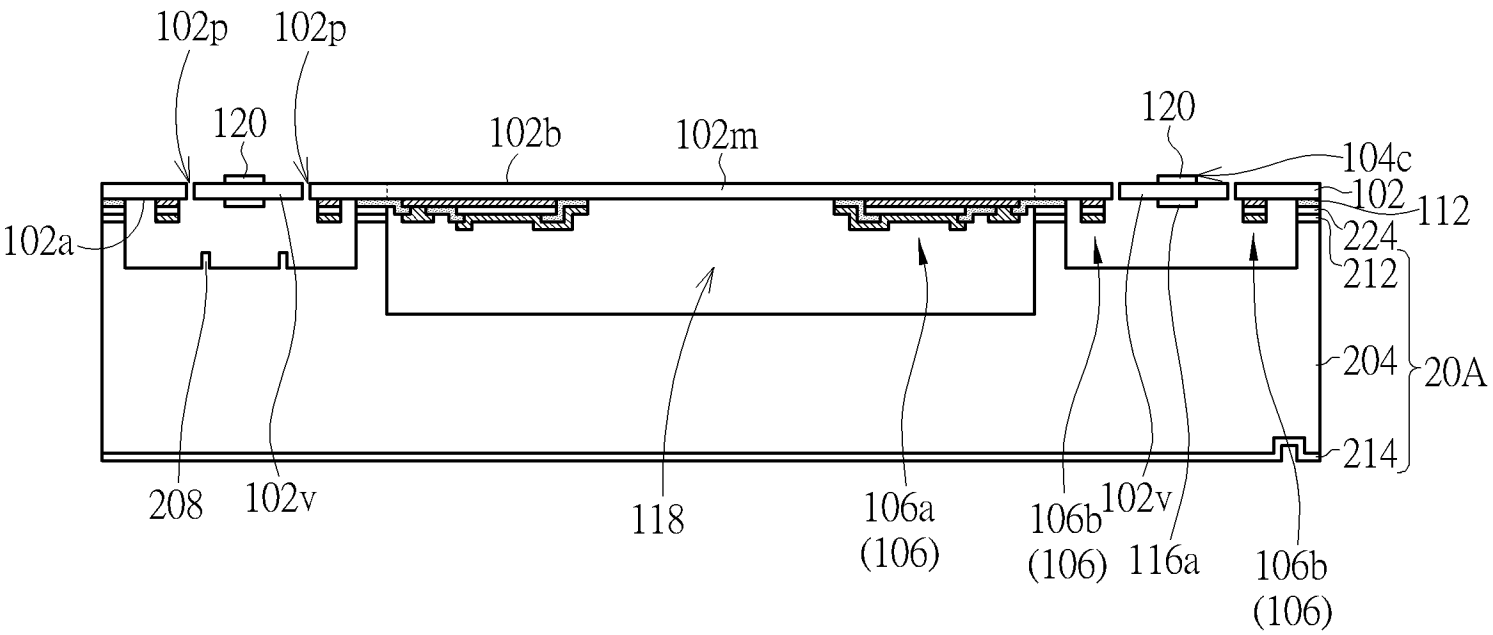
Figure 13:
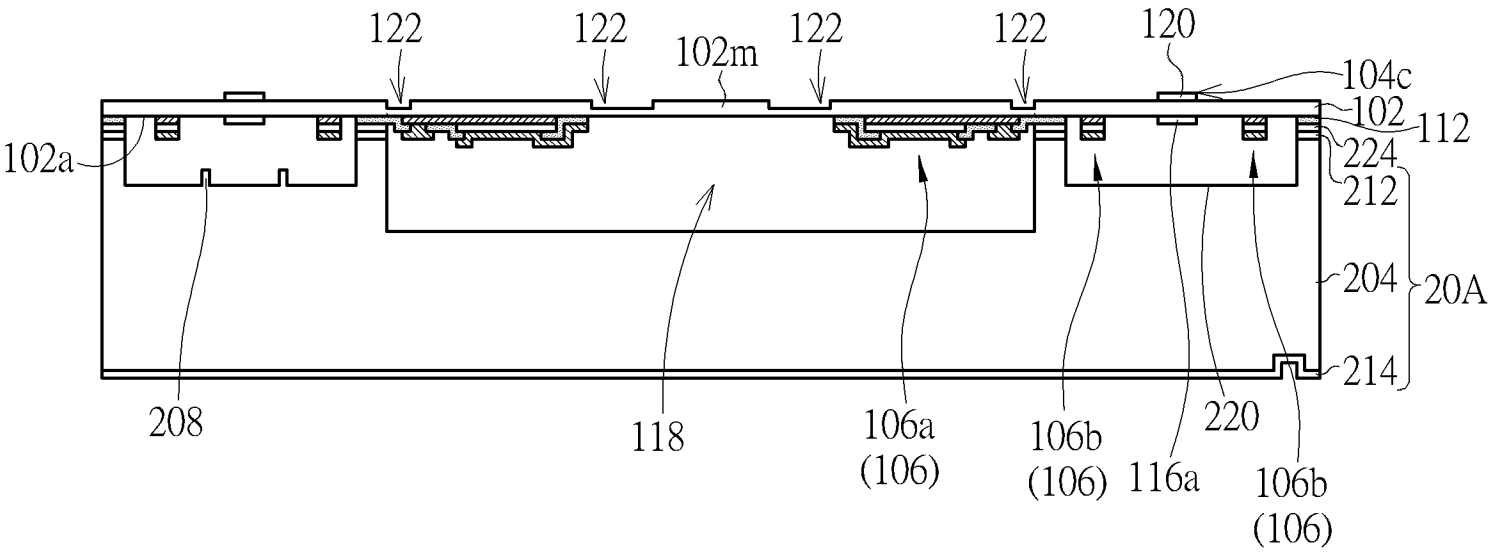
FIG. 13 schematically illustrate a structure that the membrane is etched to have recesses according to some embodiments of the present invention.

As shown in FIG. 1 and FIG. 9, in step S108, after the protection layer 104*c* is patterned, the thin film layer 102 is patterned to form a plurality of valves 102*v* for controlling air flow direction. Specifically, the thin film layer 102 may be patterned to have a plurality of openings 102*p*, and two of the openings 102*p* are on two sides of one of the valves 102*v* to form the corresponding valve 102*v*. Each valve 102*v* corresponds to one of the recesses 220 of the first plate 20A in the top view, and two of the valve actuators 106*b* are disposed on two sides of one of the valves 102*v*. In some embodiments, as shown in FIG. 13, the surface 102*b* of the membrane 102*m* may be optionally etched to form a plurality of recesses 122 for reducing stiffness of the membrane 102*m* and increasing oscillation amplitude of the membrane 102*m*. The etching of the membrane 102*m* may be performed by wet etching, such as KOH or TMAH, or dry etching, such as plasma.

Figure 10:
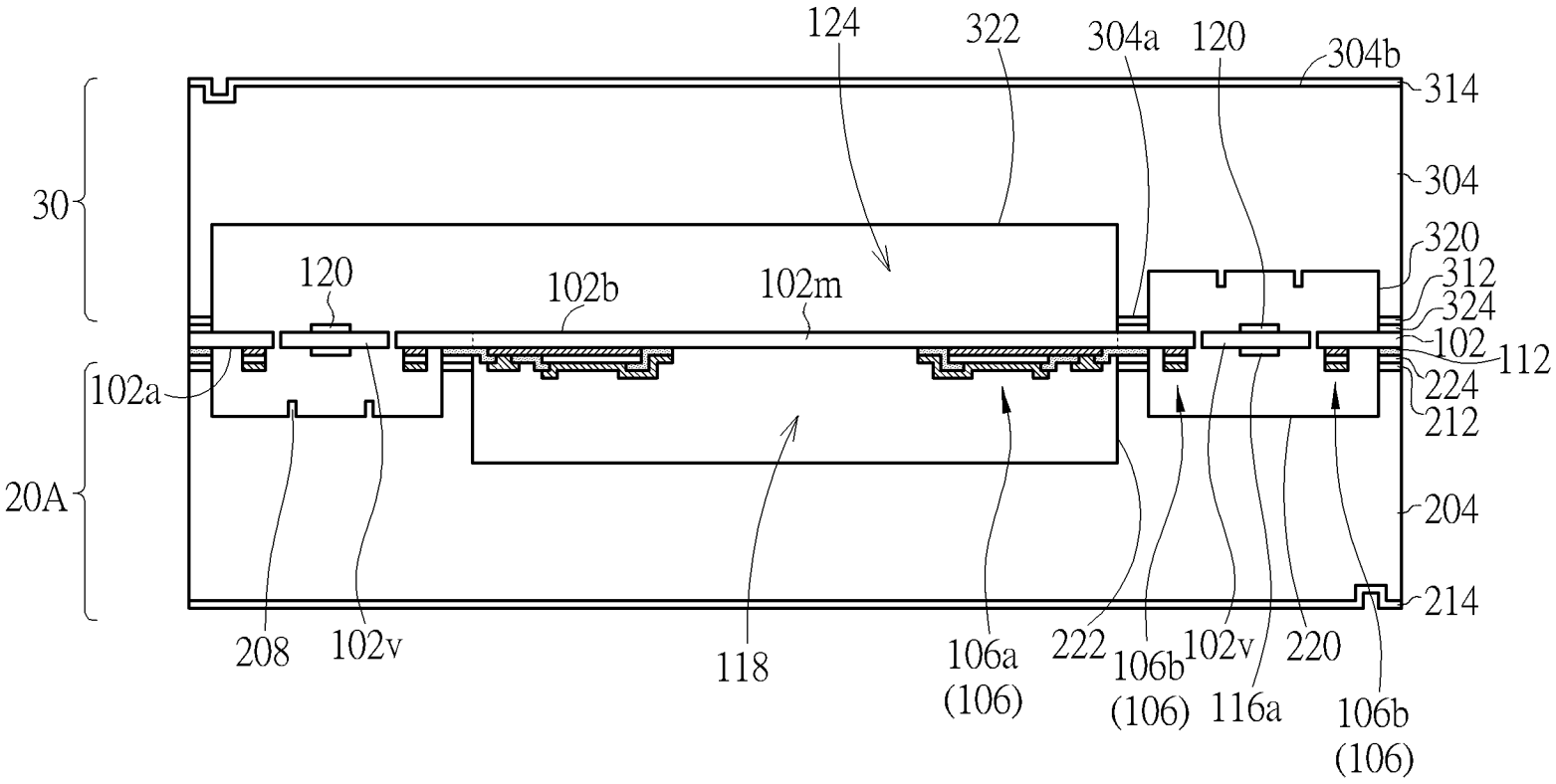

As shown in FIG. 1 and FIG. 10, in step S110, a second plate 30 is bonded on the surface 102*b* of the thin film layer 102 opposite to the first plate 20A to form a second chamber 124 between the thin film layer 102 and the second plate 30, in which the second chamber 124 and the first chamber 118 are located at two sides of the membrane 102*m*. In this embodiment, the second plate 30 includes a substrate 304 and two etching stop layers 312, 314 on two surfaces 304*a*, 304*b* of the substrate 304 respectively, and the surface 304*a* of the substrate 304 has a plurality of recesses 320 and a recess 322 that have different depths. The second plate 30 may be bonded on the thin film layer 102 through a second bonding agent 324. The bonding between the thin film layer 102 and the second plate 30 may for example use dry film, spin on glass (SOG), eutectic bonding, photoresist, thermal compression, low-temperature fusion or other suitable bonding method. For example, the second bonding agent 324 may include polymer material, glass frit, metal eutectic or other suitable material, but not limited thereto. The second bonding agent 324 including the polymer material may for example include dry film, Benzocyclobutene (BCB), SU-8, polyimide or epoxy, in which SU-8 and the dry film may include negative photoresist material. Since the recesses 320 are connected to the recess 322, the second chamber 124 may be enclosed by the recesses 320, recess 322 and the thin film layer 102. A portion of the second chamber 124 overlaps one of the recesses 220 in the top view, and a portion of the first chamber 118 also overlaps one of the recesses 320 (not shown in figures). The relation between the first chamber 118 and the recesses 320 and the relation between the second chamber 124 and the recesses 220 may be adjusted based on the design requirements. The second plate 30 may be different from the first plate 20A in that the top view positions of the recesses 320 are different from the top view positions of the recesses 220, the top view shape of the recess 322 is different from the top view shape of the recess 222, and the method for forming the second plate 30 may be similar to or the same as the method for forming the first plate 20A and thus is not narrated herein for brevity.

Figure 11:
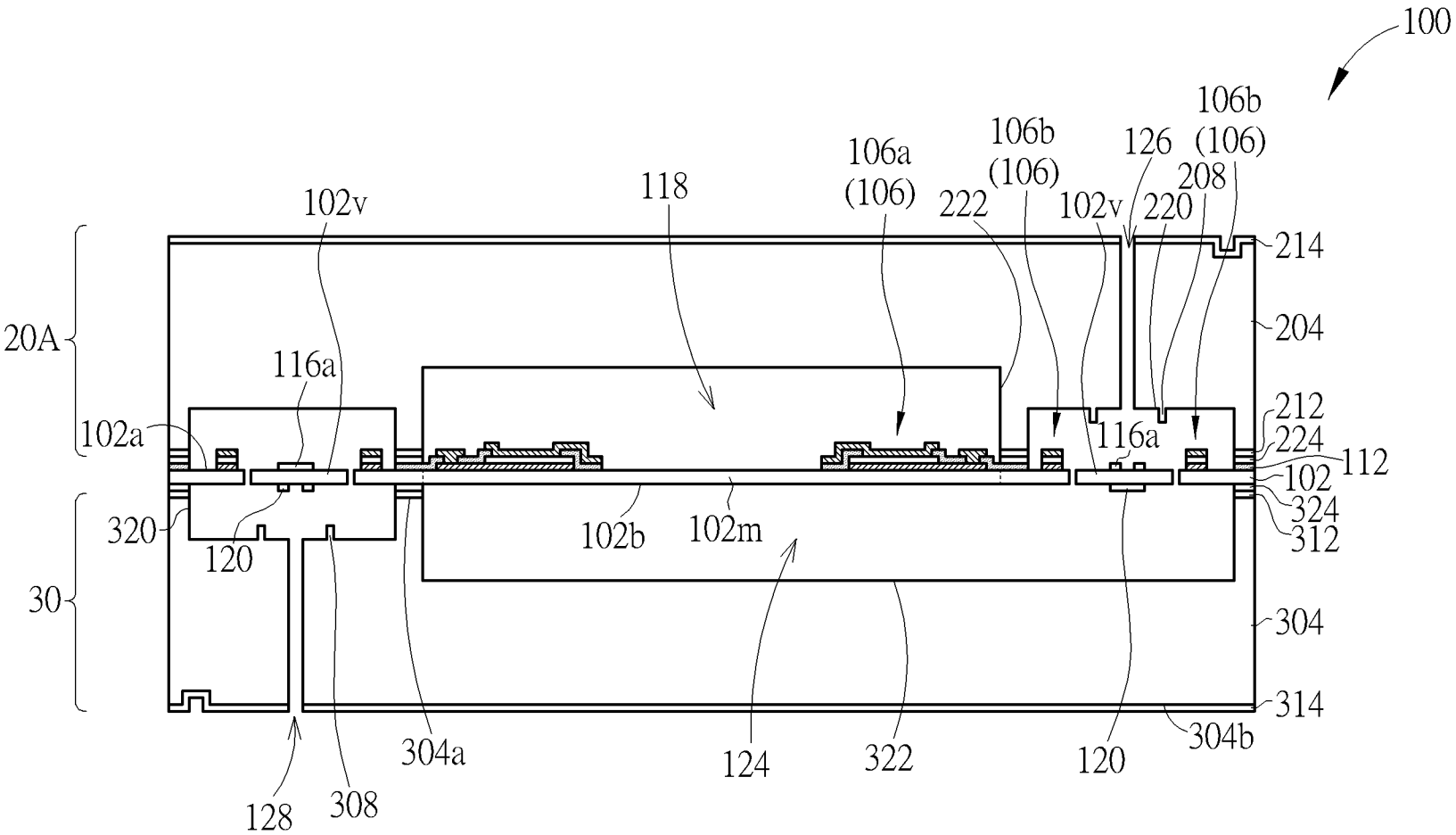

As shown in FIG. 1 and FIG. 11, in step S112, a plurality of channels 126, 128 are formed in the first plate 20A and the second plate 30, thereby forming the air pulse generating element 100 of this embodiment. Specifically, the etching stop layers 214, 314 are patterned at different times to expose portions of the substrates 204, 304 that correspond to the valves 102*v*, and then the exposed substrate 204, 304 are etched to form the channels 126, 128. In this embodiment, the channel 126 penetrates through the substrate 204 of the first plate 20A, and the protrusion 208 surrounds the channel 126. The channel 128 penetrates through the substrate 304 of the second plate 30, and the protrusion 308 surrounds the channel 128. Accordingly, the channel 126 corresponds to and exposes one of the insulation block 116*a* on corresponding valve 102*v*, and the channel 128 corresponds to and exposes one of the protection block 120 on corresponding valve 102*v*. In some embodiments, another etching process may be performed to the insulation block 116*a* and the protection block 120 facing the channels 126, 128 respectively after the channels 126, 128 are formed, so as to reduce the thickness and the area of the insulation block 116*a* and the protection block 120 on the valves 120*v* and facilitating the flatness of the valves 120*v*. In this embodiment, the first plate 20A and the second plate 30 may be a front plate and a back plate respectively, but not limited thereto. In some embodiments, the first plate 20A and the second plate 30 may be the back plate and the front plate respectively. The detailed structure of the formed air pulse generating element 100 and its variant may be referred to U.S. application Ser. No. 16/172,876, which are not narrated herein for brevity. As the method for manufacturing the air pulse generating element 100 mentioned above, the valves 102*v* and the membrane 102*m* are formed of the same thin film layer 102, and the actuators 106 are formed on the same surface of the thin film layer 102, so the manufacturing complexity is lowered, and the yield rate is improved.

Figure 14:
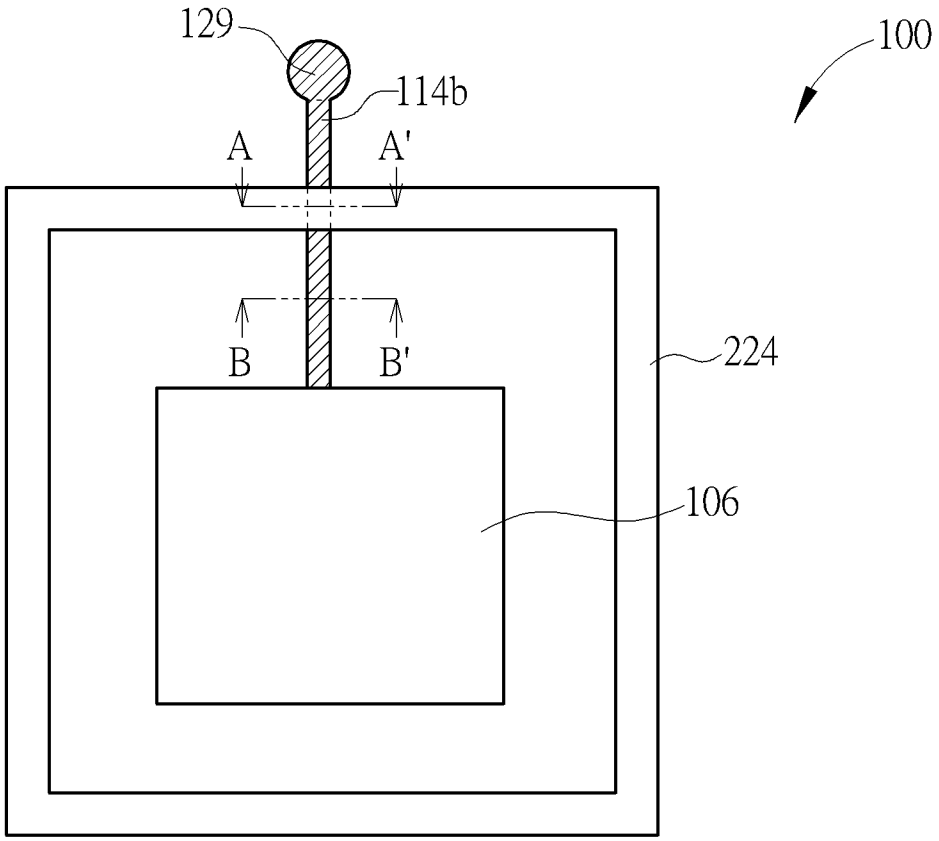
FIG. 14 schematically illustrates a top view of the air pulse generating element according to the first embodiment of the present invention.
Figure 15:
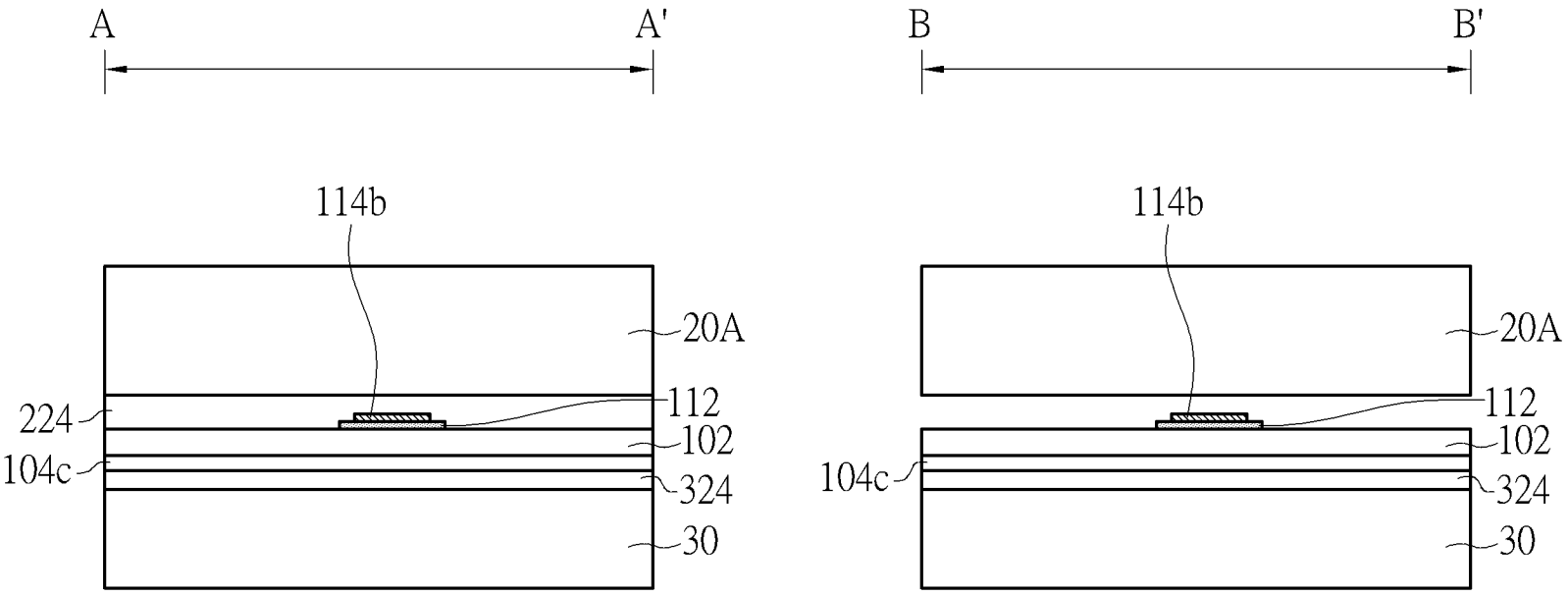
FIG. 15 schematically illustrates sectional views taken along lines A-A' and B-B' of FIG. 14.

FIG. 14 schematically illustrates a top view of the air pulse generating element according to the first embodiment of the present invention, and FIG. 15 schematically illustrates sectional views taken along lines A-A' and B-B' of FIG. 14. For brevity, FIG. 14 shows one actuator 106, but not limited thereto. As shown in FIG. 14 and FIG. 15, the actuator 106 is surrounded by first bonding agent 224, and therefore, in order to electrically connect the actuator 106 to the bonding pad 129 outside the first bonding agent 224, the trace 114*b* formed on the thin film layer 102 is extended to cross the first bonding agent 224 and be connected to the bonding pad 129.

Figure 16:
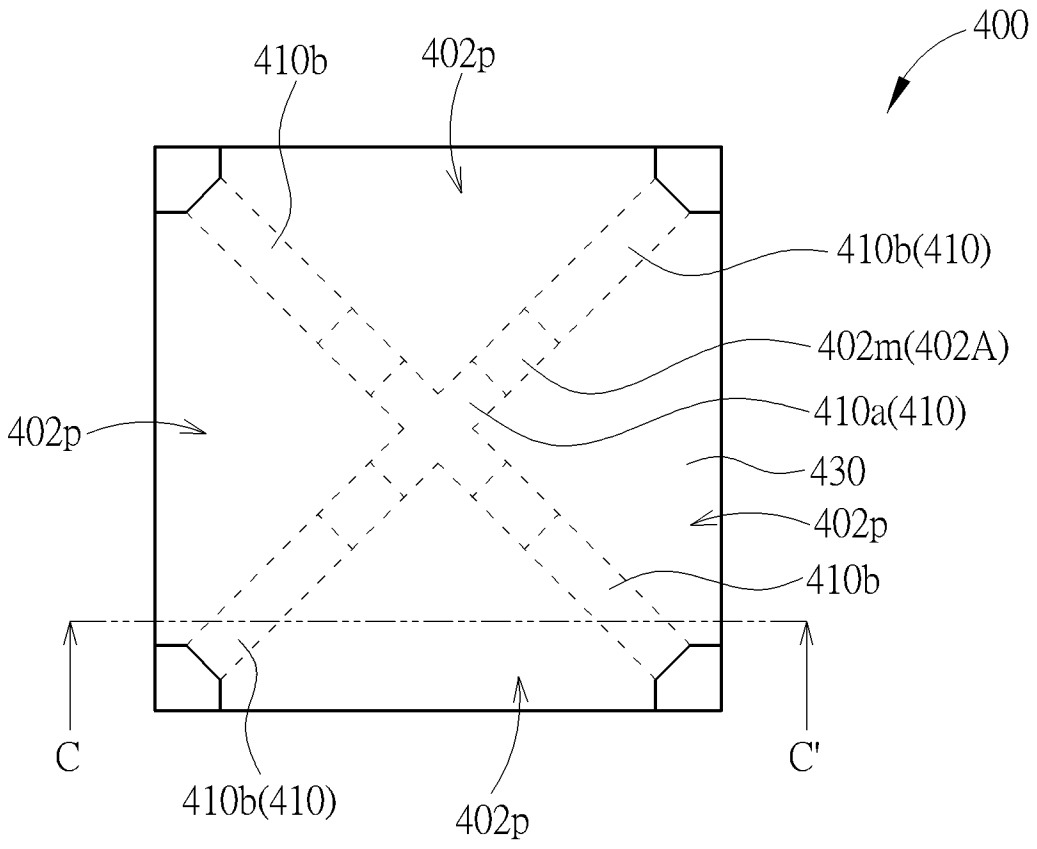
FIG. 16 schematically illustrates a top view of an air pulse generating element according to a second embodiment of the present invention.
Figure 17:
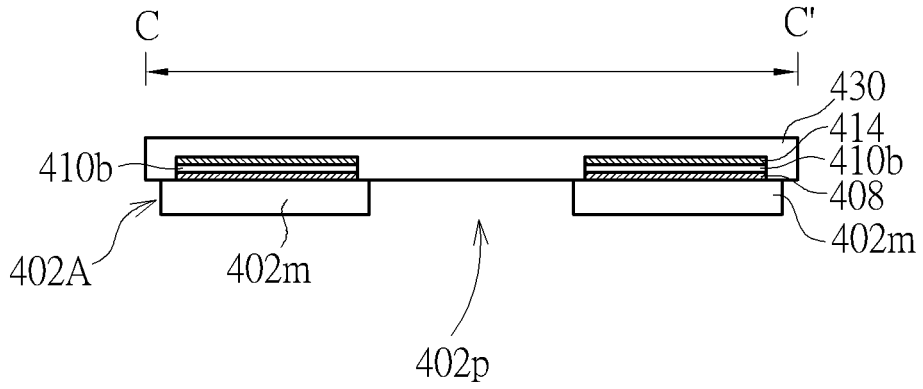
FIG. 17 is a schematic diagram illustrating a sectional view taken along line C-C' of FIG. 16.

FIG. 16 schematically illustrates a top view of an air pulse generating element according to a second embodiment of the present invention, and FIG. 17 is a schematic diagram illustrating a sectional view taken along line C-C' of FIG. 16, in which for brevity, FIG. 16 and FIG. 17 only show a portion of the air pulse generating element, for example the membrane, the deformable layer and an elastic layer, but not limited thereto. The air pulse generating element 400 of this embodiment is different from the first embodiment shown in FIG. 11 in that the membrane 402*m* may be patterned to have at least one opening 402*p*, and the opening 402*p* may be covered with a layer formed of a material with higher elasticity than the membrane 402*m*, so as to reduce the stiffness of the membrane 402*m*. In this embodiment, the air pulse generating element 400 further includes the elastic layer 430 covering the opening 402*p*, and the elastic layer 430 may be formed of polymer material. For example, the membrane 402*m* of the thin film layer 402A may be patterned into a cross-shape and have the openings 402*p*, and the deformable layer 410 may be patterned into a cross block 410*a* and four straight blocks 410*b*. The cross block 410*a* is disposed on a cross portion (center) of the cross-shape membrane 402*m*, and the four straight blocks 410*b* are disposed on the membrane 402*m* near four ends of the cross-shape membrane 402*m*, in which the four straight blocks 410*b* are separated from the cross block 410*a*. The elastic layer 430 is formed to cover the opening 402*p*, such that the elastic layer 430 and the membrane 402*m* can form a composite membrane, which can prevent air from pass through the opening 402*p*. Since a portion of the membrane 402*m* formed of semiconductor is removed and covered with the elastic layer 430 formed of polymer material, the stiffness of the composite membrane may be lower than the stiffness of the membrane 402*m*, thereby increasing oscillation amplitude. The bottom conductor layer 408 is disposed between the membrane 402*m* and the deformable layer 410, the top conductive layer 414 may be disposed on the deformable layer 410, and the layout of the patterned bottom conductive layer 408 and the layout of the patterned top conductive layer 414 may be designed based on the requirements.

Figure 18:
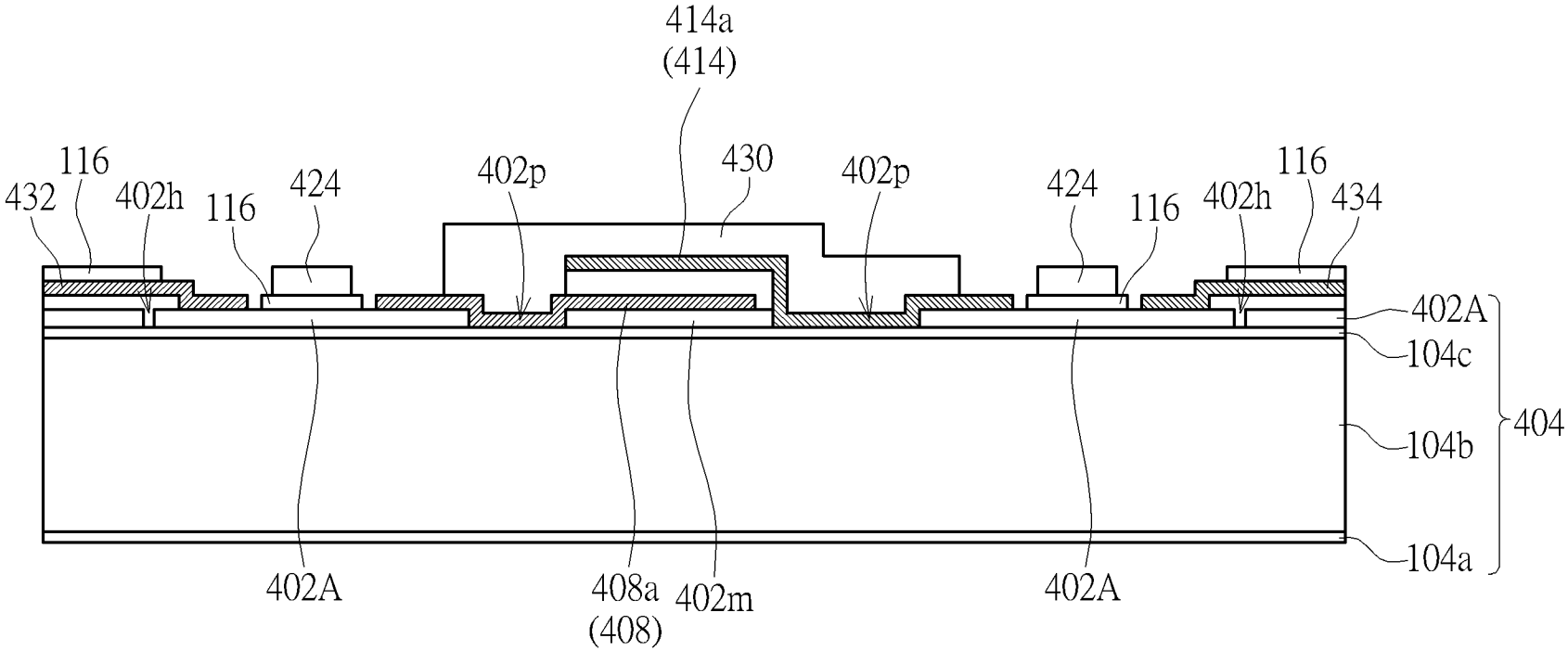
FIG. 18 to FIG. 19 schematically illustrate a method for manufacturing the air pulse generating element according to the second embodiment of the present invention.
Figure 19:
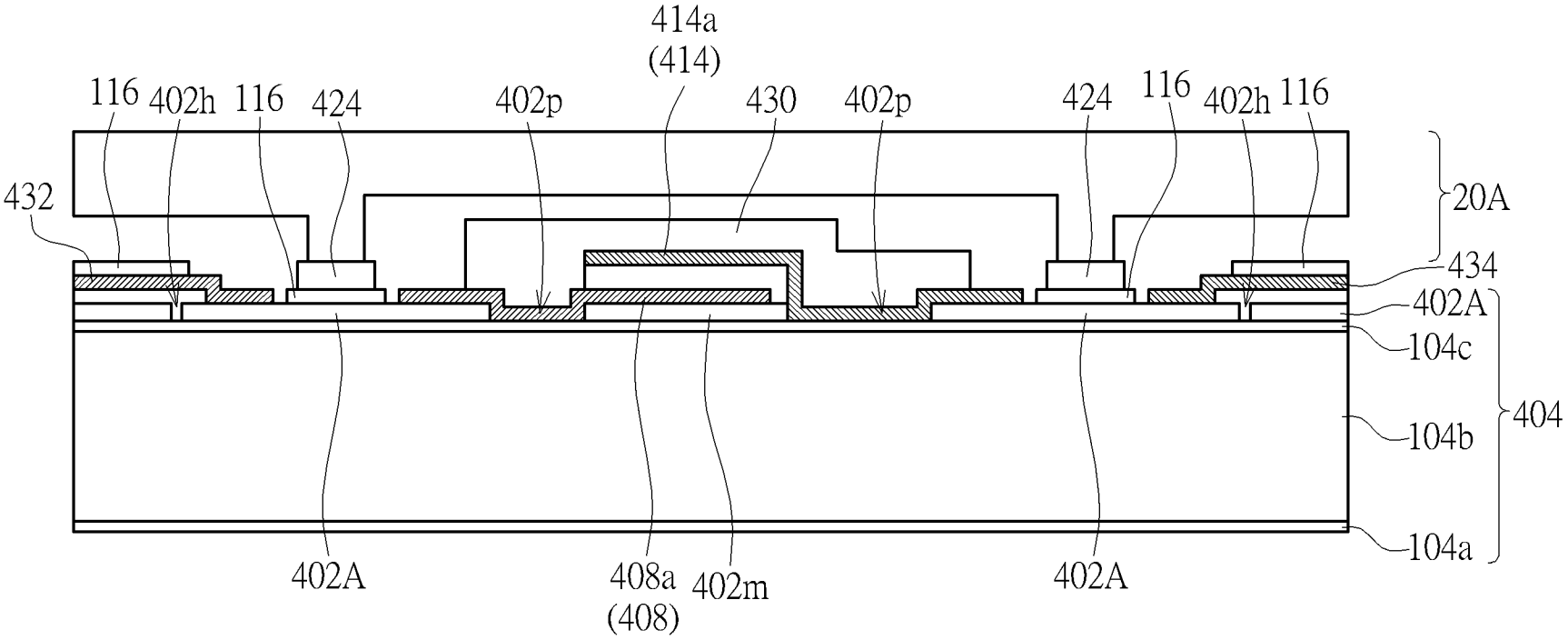

FIG. 18 to FIG. 19 schematically illustrate a method for manufacturing the air pulse generating element according to the second embodiment of the present invention, in which the insulation layer 112 is not shown in FIGS. 18 and 19, but the present invention is not limited thereto. In this embodiment, as shown in FIG. 18, after the substrate 404 is provided, the thin film layer 402A may be patterned to form the openings 402*p* in the membrane 402*m*, and then, the bottom conductive layer 408 is deposited. The method of this embodiment from the step of depositing the bottom conductive layer 408 to the step of forming the insulation layer 116 are the same as the first embodiment and are not narrated herein for brevity. In some embodiments, the step of patterning the thin film layer 402A may further form a plurality of through holes 402*h* for separating different portions of the patterned thin film layer 402A, such that some portions of the patterned thin film layer 402A may serve as traces for electrically connecting the formed first electrode 408*a* to a bonding pad 432 or other components and electrically connecting the formed second electrode 414*a* to another bonding pads 434 or other components. In addition, a portion of the bottom conductive layer 408 may extend into the opening 402*p*, and the portion of the bottom conductive layer 408 may be electrically connected between the portion of the patterned thin film layer 402A serving as the trace and the formed first electrode 408*a*. Similarly, a portion of the top conductive layer 414 extending in the opening 402*p* may be electrically connected between another portion of the patterned thin film layer 402A serving as another trace and the formed second electrode 414*a*.

After the insulation layer 116 is formed, the elastic layer 430 is blankly formed on the substrate 404 for example by spin coating and then is patterned, in which the patterned elastic layer 430 covers the opening 402*p*. In this embodiment, the first bonding agent 424 may be formed on the insulation layer 116 between forming the insulation layer 116 and forming the elastic layer 430 or after the elastic layer 430 is formed. As shown in FIG. 19, after the elastic layer 430 is formed, the first plate 20A is bonded on the thin film layer 402A through the first bonding agent 424. Also, the steps of the method of this embodiment after bonding the first plate 20A on the thin film layer 402A may be like or the same as the first embodiment and are not narrated herein for brevity.

Figure 20:
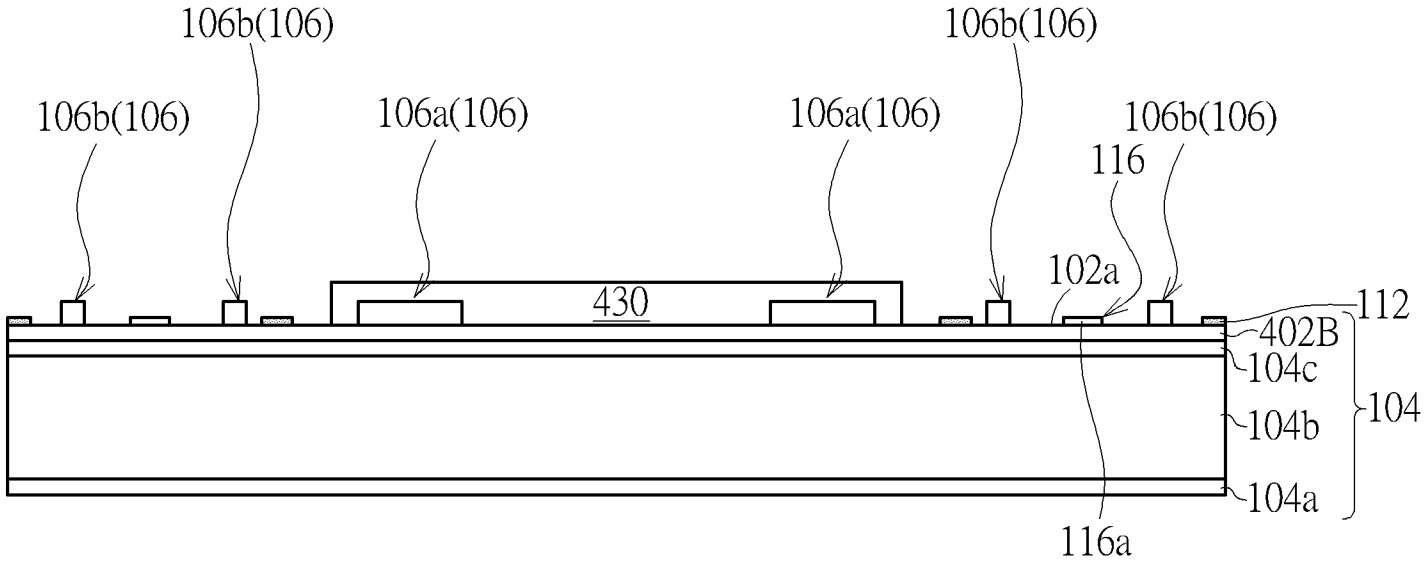
FIG. 20 to FIG. 21 schematically illustrate a method for manufacturing an air pulse generating element according to a variant embodiment of the second embodiment of the present invention.
Figure 21:
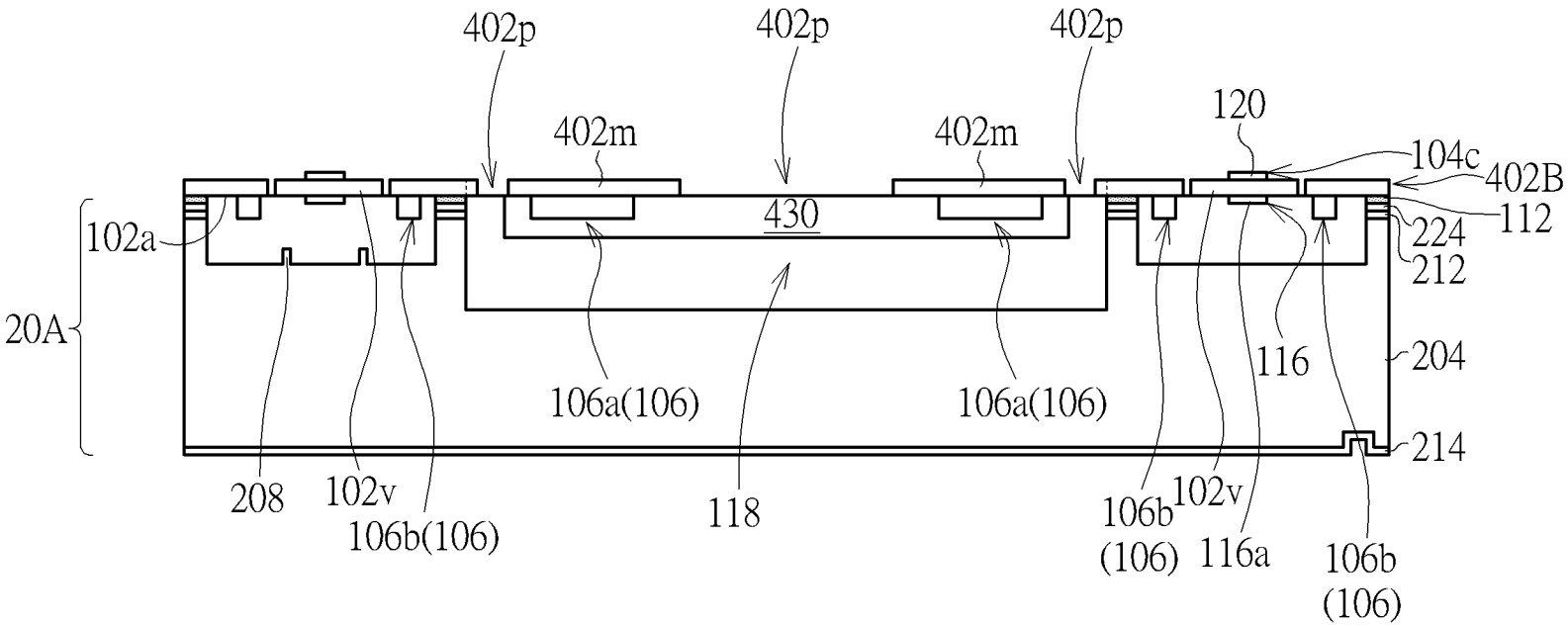

FIG. 20 to FIG. 21 schematically illustrate a method for manufacturing an air pulse generating element according to a variant embodiment of the second embodiment of the present invention. As shown in FIG. 20, the difference between the method of this variant embodiment and the above second embodiment is that the thin film layer 402B is not patterned before forming the elastic layer 430 in this embodiment. Thus, the steps before forming the elastic layer 430 may be the same as the steps before bonding the first plate 20A in the first embodiment. As shown in FIG. 21, the step of patterning the thin film layer 402B may further form the openings 402*p* in the membrane 402*m* to reduce the stiffness of the membrane 402*m*. Other steps of this variant embodiment are like or the same the first embodiment and are not narrated herein for brevity.

Figure 22:
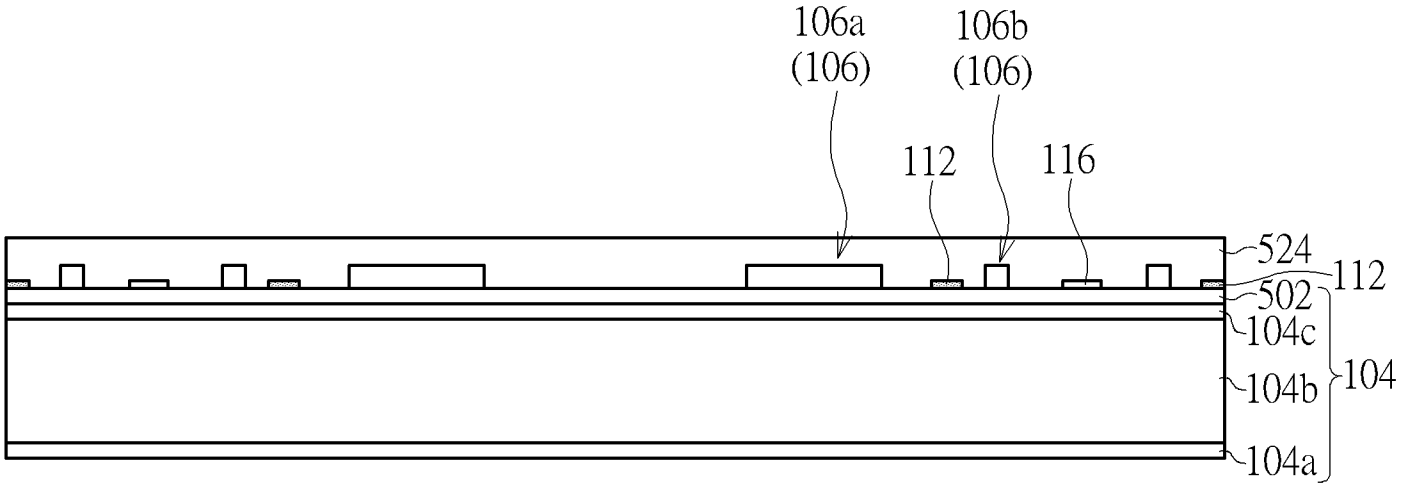
FIG. 22 to FIG. 24 schematically illustrate a method for manufacturing an air pulse generating element according to a third embodiment of the present invention.
Figure 23:
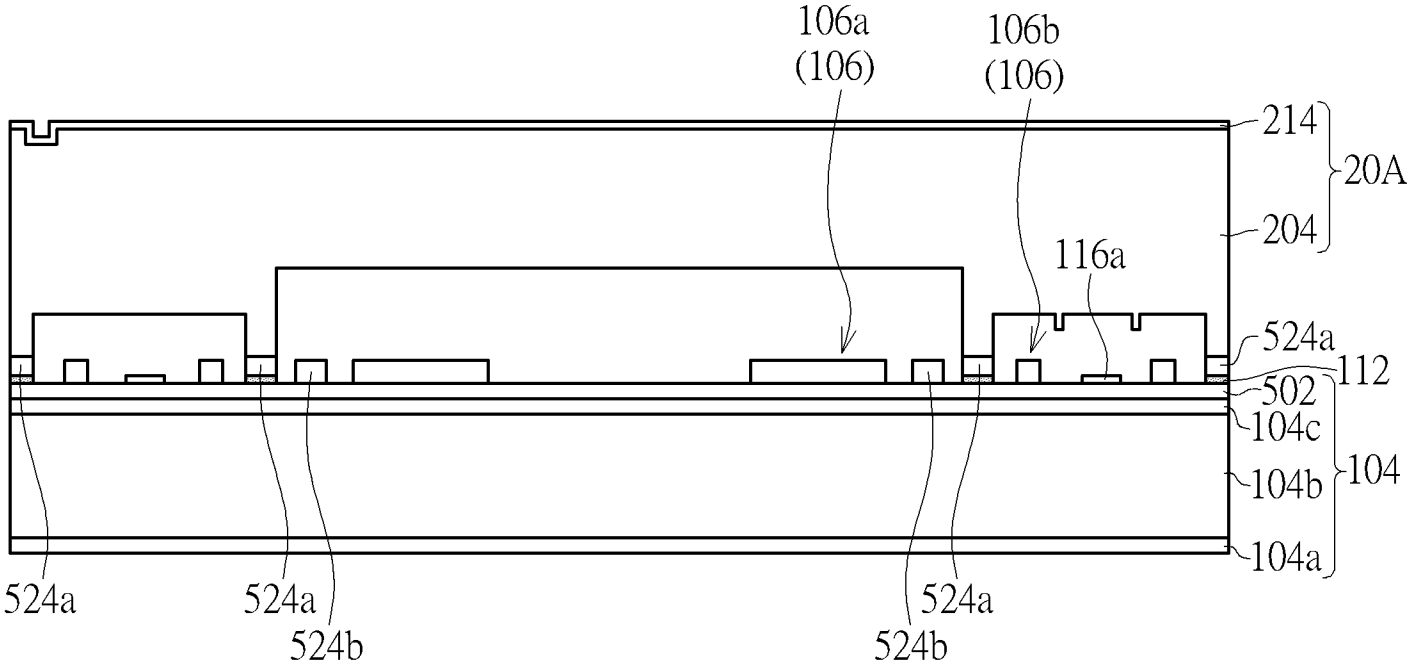
Figure 24:
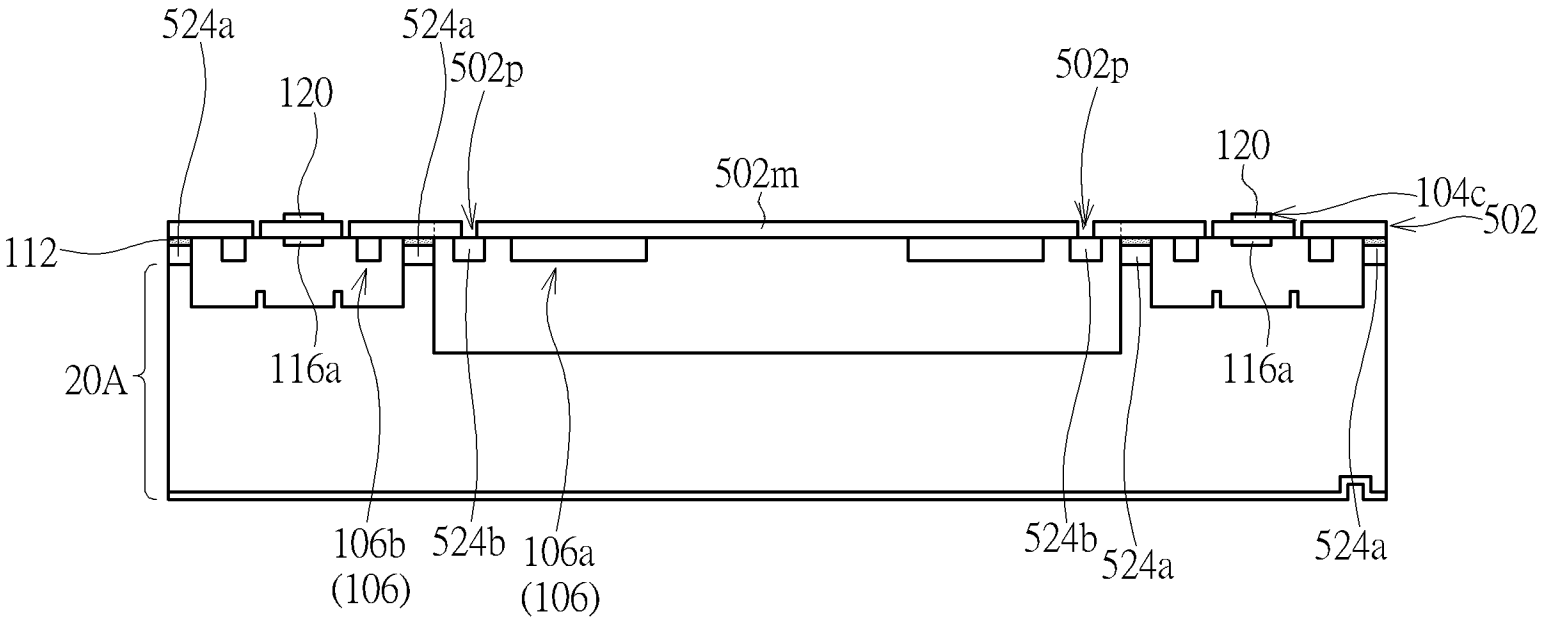

FIG. 22 to FIG. 24 schematically illustrate a method for manufacturing an air pulse generating element according to a third embodiment of the present invention, in which the actuators and insulation layers in FIG. 22 to FIG. 24 are shown only for illustration purposes and are not limited thereto. The method for manufacturing the air pulse generating element of this embodiment is different from the first embodiment shown in FIG. 2 to FIG. 11 in that the first bonding agent 524 is formed on the thin film layer 502 before bonding the first plate 20A on the thin film layer 502. Specifically, as shown in FIG. 22, the first bonding agent 524 may be blankly formed on the thin film layer 502, i.e. the first bonding agent 524 covers the actuators, the insulation layers and the thin film layer 502. Then, as shown in FIG. 23, the first bonding agent 524 is patterned to form a plurality of bonding blocks 524*a*. After that, the first plate 20A without the first bonding agent 524 may be bonded on the thin film layer 502 through the bonding blocks 524*a*. In some embodiments, as shown in FIG. 23, the patterning of the first bonding agent 524 may further form at least one sealing block 524*b* for sealing following formed openings 502*p* in the membrane 502*m*. In such situation, as shown in FIG. 24, the step of patterning the thin film layer 502 may further include patterning a portion of the membrane 502*m* corresponding to the sealing block 524*b* to have at least one opening 502*p*. The opening 502*p* is covered with the sealing block 524*b*, and the membrane 502*m* and the sealing block 524*b* may form a composite membrane. Since the first bonding agent 524 may be for example formed of photoresist material, the oscillation amplitude of the composite membrane can be increased.

Figure 25:
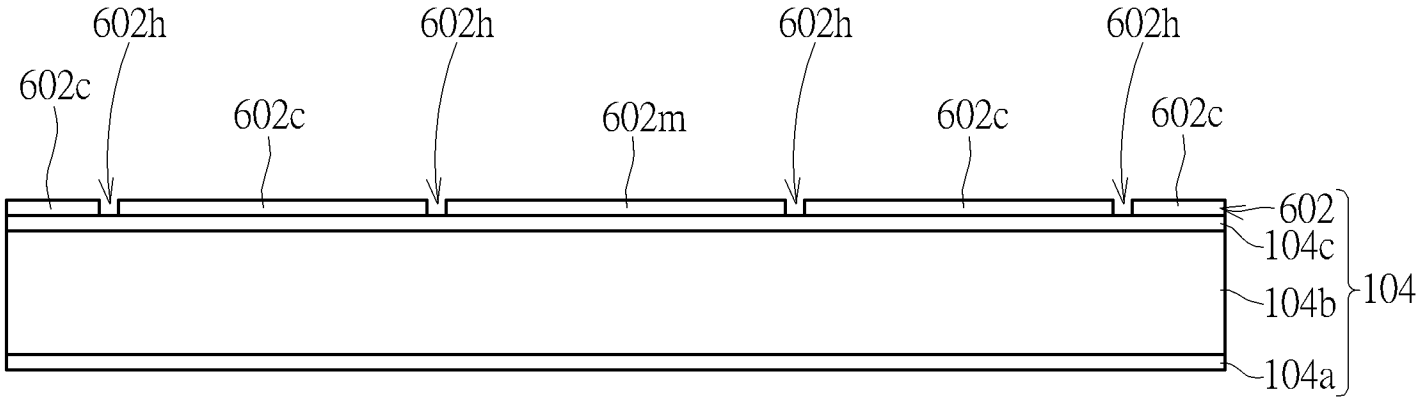
FIG. 25 to FIG. 28 schematically illustrate a method for manufacturing an air pulse generating element according to a fourth embodiment of the present invention.

FIG. 25 to FIG. 28 schematically illustrate a method for manufacturing an air pulse generating element according to a fourth embodiment of the present invention. The difference between the method of this embodiment and the first embodiment is that the step of pattering thin film layer 602 further includes forming a plurality of connecting blocks 602*c* for serving as traces in this embodiment. Specifically, as shown in FIG. 25, after the substrate 104 is provided, the thin film layer 602 may be patterned to form the membrane 602*m*, the valves (not shown in FIG. 25 to FIG. 28), the connecting blocks 602*c* and through holes 602*h* between the membrane 602*m* and the connecting blocks 602*c*, between the connecting blocks 602*c* and between the connecting blocks 602*c* and the valves. In this embodiment, the thin film layer 602 may include highly-doped semiconductor material for providing high conductivity.

Figure 26:
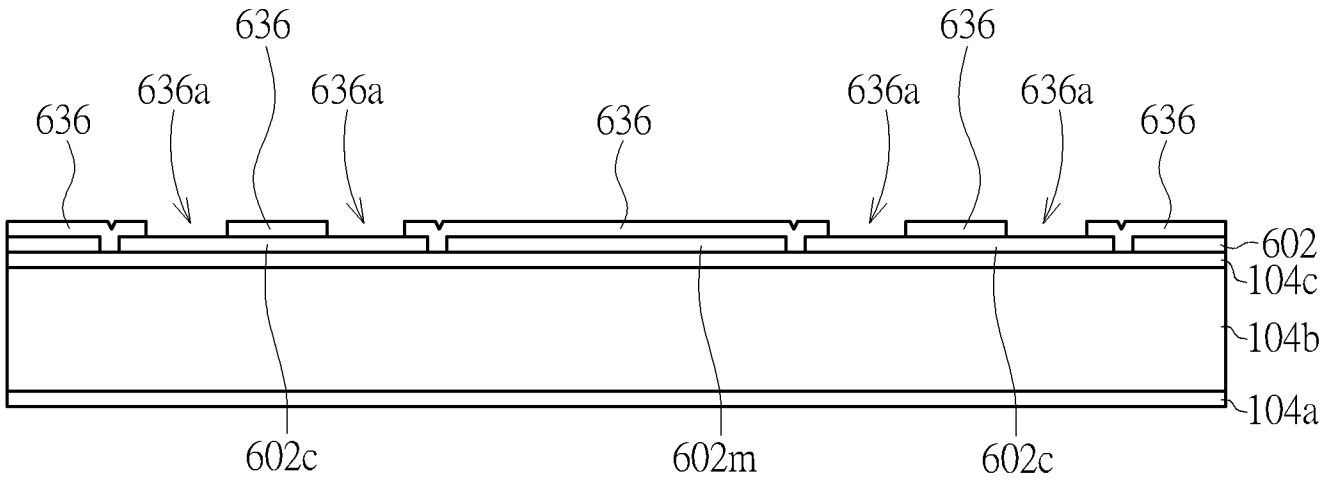

As shown in FIG. 26, after the thin film layer 602 is patterned, an insulation layer 636 is formed to fill up the through holes 602*h* and to cover the thin film layer 602. Then, the insulation layer 636 is patterned to form a plurality of openings 636*a*, in which each connecting blocks 602*c* may be exposed by two of the openings 636*a*.

Figure 27:
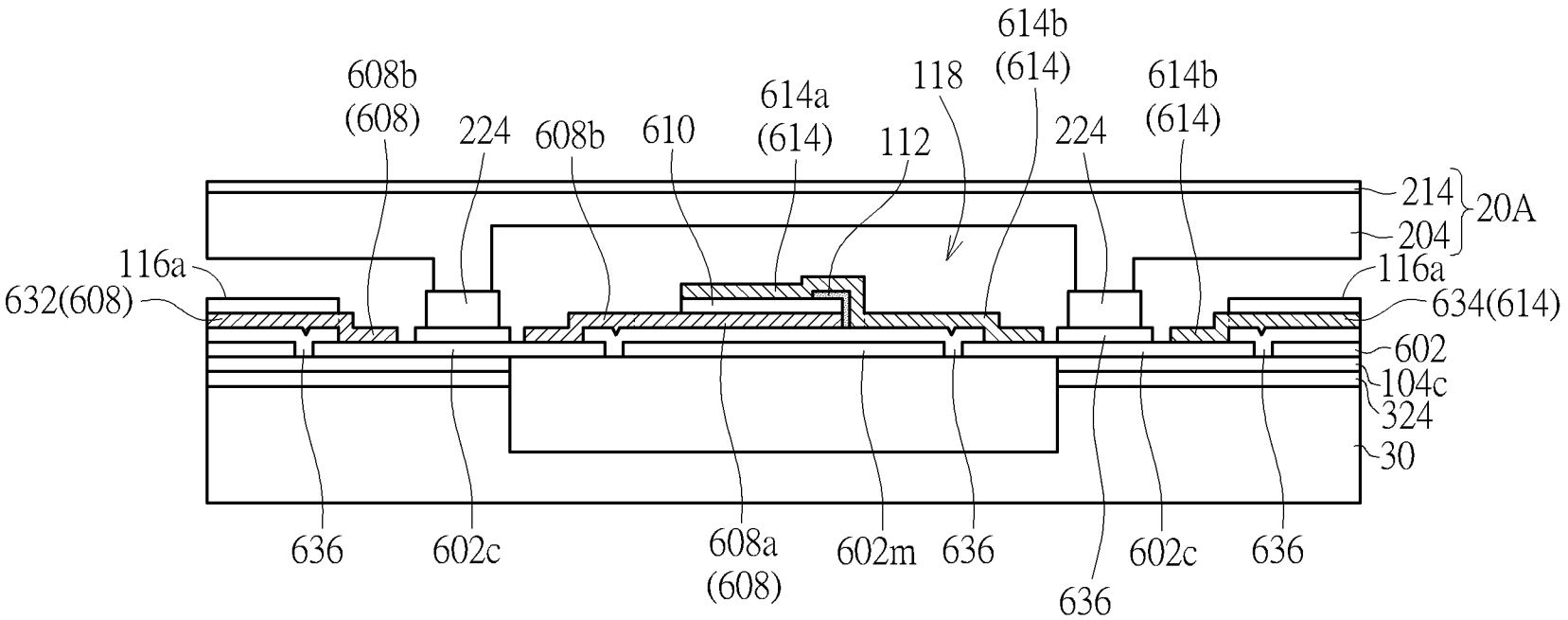

As shown in FIG. 27, the bottom conductive layer 608 is then deposited on the insulation layer 636 and the thin film layer 602 and then patterned to form the first electrode 608*a*, traces 608*b* and bonding pad 632, in which one of the traces 608*b* may be disposed inside the first chamber 118 and connects the first electrode 608*a* to one end of one of the connecting blocks 602*c* through one of the openings 636*a*, and another one of the traces 608*b* may be disposed outside the first chamber and connects the other end of the connecting block 602*c* to the corresponding bonding pad 632. After patterning the bottom conductive layer 608, the deformable layer 610 is deposited and patterned on the membrane 602*m* and followed by depositing and patterning the insulation layer 112. After that, the top conductive layer 614 is deposited and patterned to form the second electrode 614*a*, traces 614*b* and bonding pad 634, which one of the traces 614*b* may be disposed inside the first chamber 118 and connects the second electrode 614*a* to one end of another one of the connecting blocks 602*c* through one of the openings 636*a*, and another one of the traces 614*b* may be disposed outside the first chamber 118 and connects the other end of the connecting block 602*c* to the corresponding bonding pad 634. Subsequently, like the first embodiment, the first plate 20A is bonded on the thin film layer 602, the protection layer 104*a* and the support substrate 104*b* are removed, the protection layer 104*c* is thinned and patterned, and then, the second plate 30 is bonded on the thin film layer 602. In some embodiments, the bonding pad 632 and the traces 608*b* may be formed of the top conductive layer 614.

Figure 28:
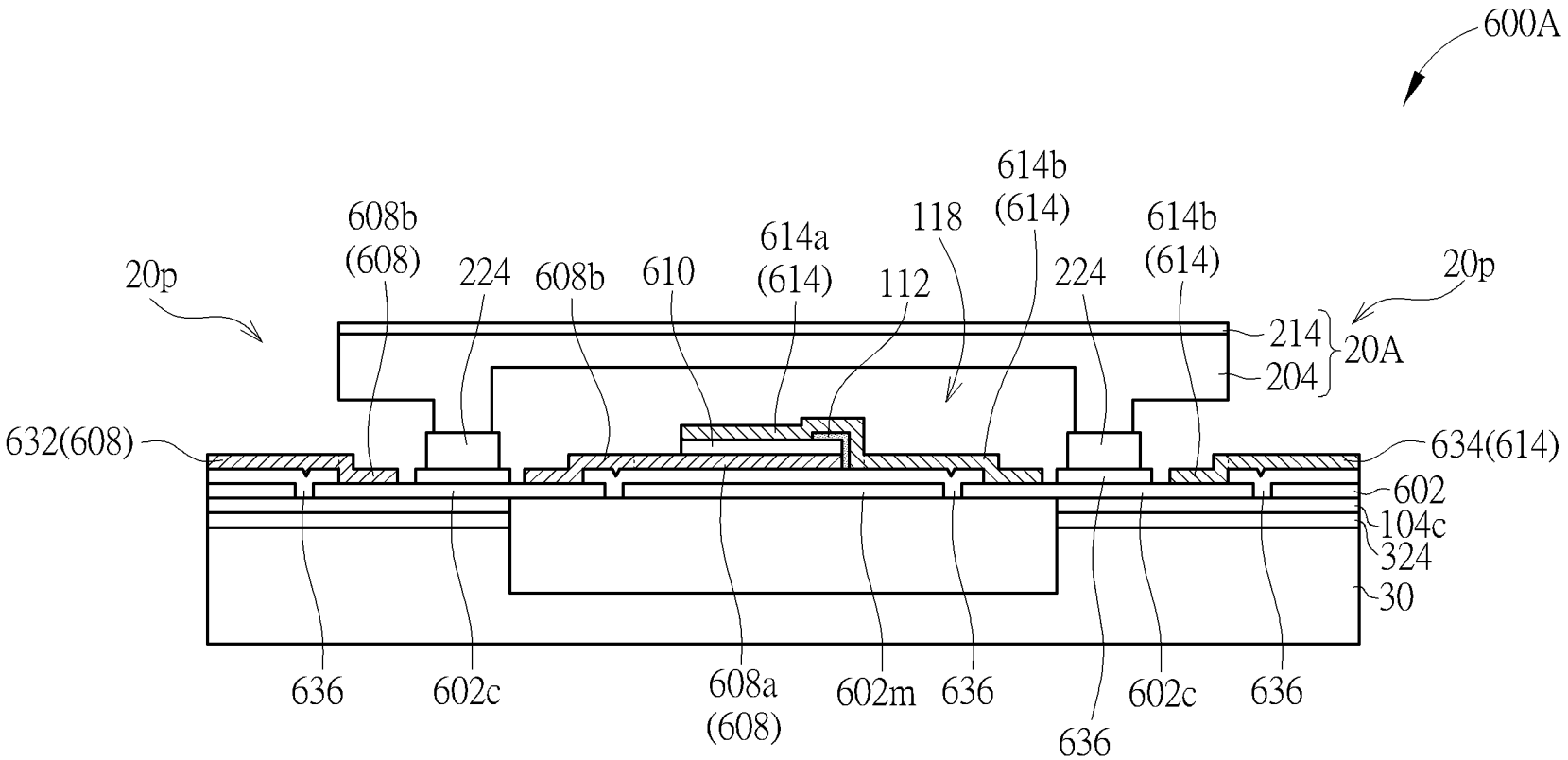

As shown in FIG. 28, the step of forming the channels (not shown in this figure) may further include etching the first plate 20A to form a plurality of openings 20*p* for exposing the insulation blocks 116*a* on the bonding pads 632, 634. Specifically, the etching stop layer 214 may be patterned to expose portions of the substrate 204 directly above the bonding pads 632, 634, and then, the portions of the substrate 204 are etched to form the openings 20*p* in the first plate 20A. After that, the insulation blocks 116*a* on the bonding pads 632, 634 are removed to expose the bonding pads 632, 634, thereby forming the air pulse generating element 600A. The formation of the openings 20*p* and the removal of the insulation blocks 116*a* facilitate the electrical connection of the bonding pads 632, 634 to the outside electronics, such as wire bonding.

Figure 29:
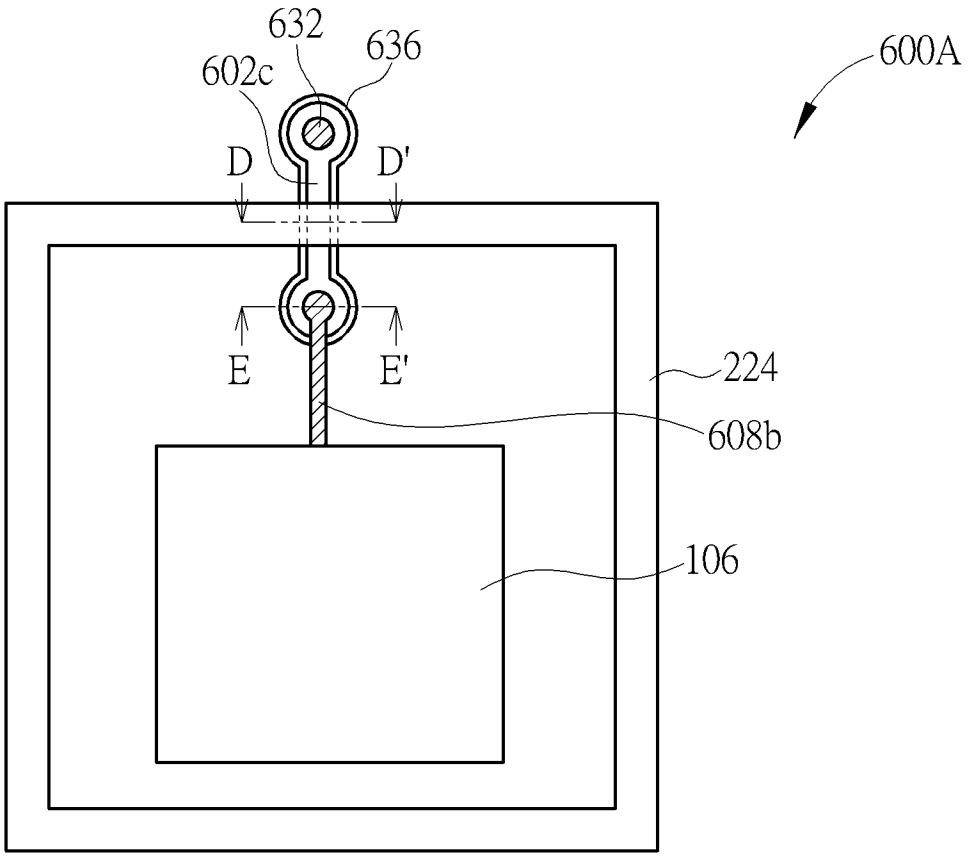
FIG. 29 schematically illustrates a top view of the air pulse generating element according to the first embodiment of the present invention.
Figure 30:
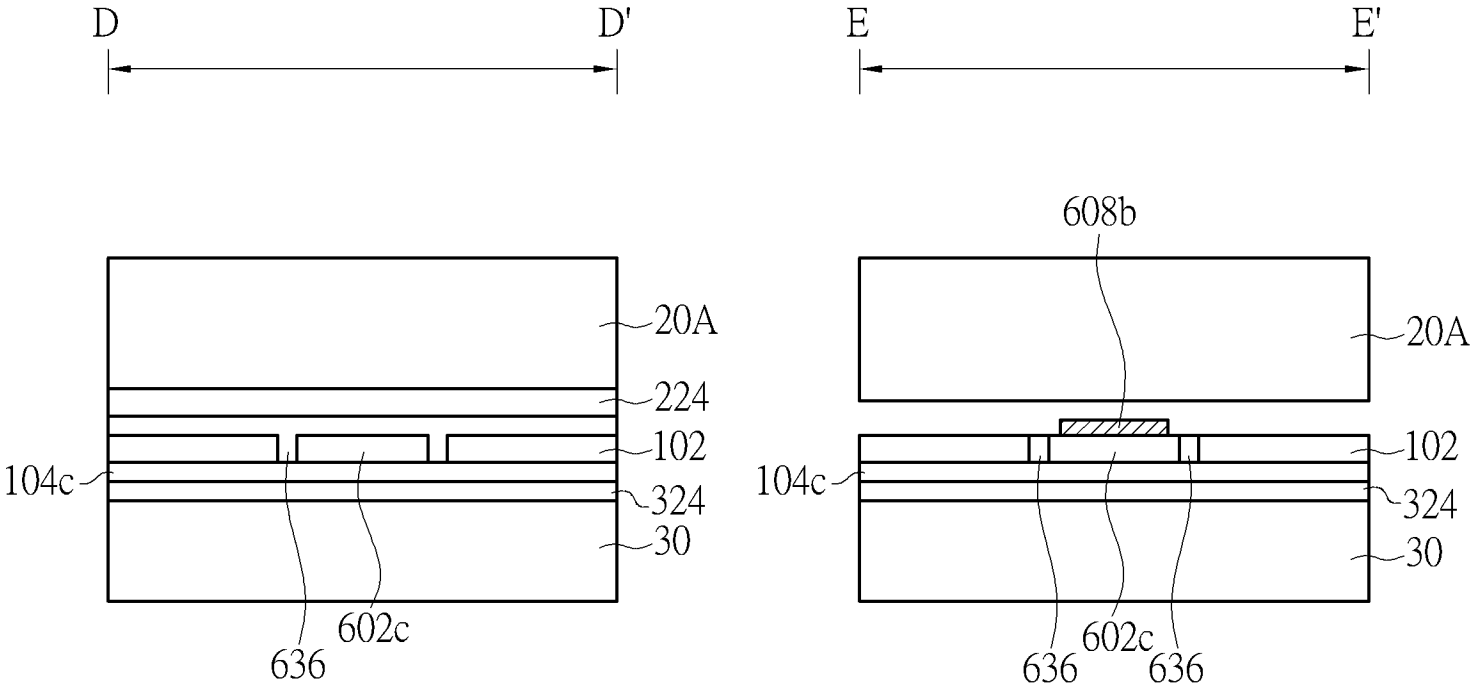
FIG. 30 schematically illustrates sectional views taken along lines D-D' and E-E' of FIG. 29.

FIG. 29 schematically illustrates a top view of the air pulse generating element according to the first embodiment of the present invention, and FIG. 30 schematically illustrates sectional views taken along lines D-D' and E-E' of FIG. 29. For brevity, FIG. 29 shows one actuator 106, but not limited thereto. As shown in FIG. 29 and FIG. 30, the actuator 106 is surrounded by first bonding agent 224, and because the first electrode 608*a* inside the first bonding agent 224 may be electrically connected to the bonding pad 632 outside the first bonding agent 224 through one of the connecting blocks 602*c* formed of the thin film layer 602, the bonding area between the first bonding agent 224 and the insulation layer 636 has no metal trace passing through, thereby improving the reliability of the air pulse generating element 600A compared to the first embodiment shown in FIG. 11.

Figure 31:
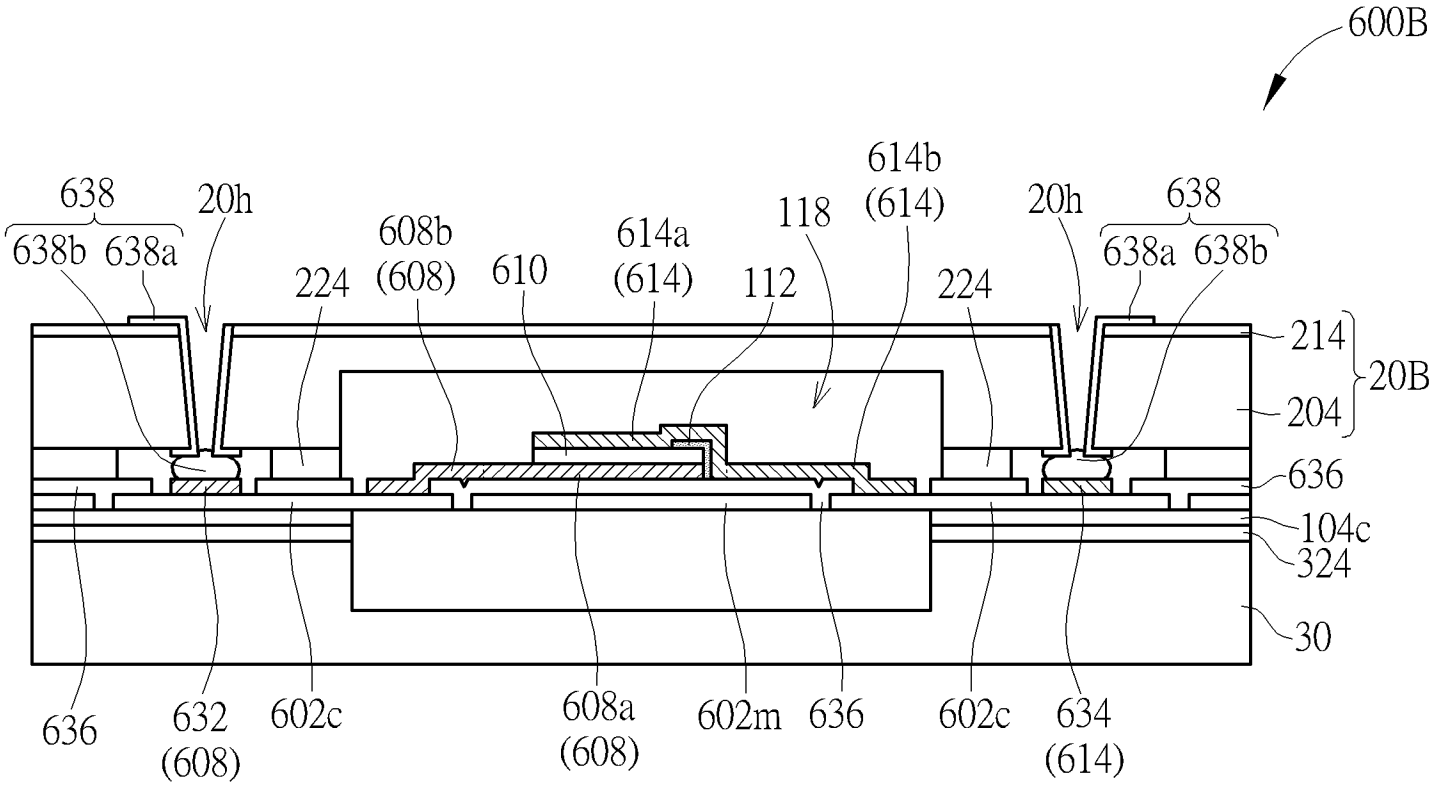
FIG. 31 schematically illustrates a sectional view of an air pulse generating element according to a variant embodiment of the fourth embodiment of the present invention.

FIG. 31 schematically illustrates a sectional view of an air pulse generating element according to a variant embodiment of the fourth embodiment of the present invention. As shown in FIG. 31, the difference between the air pulse generating element 600B and the previous fourth embodiment is that the openings 20*p* may be replaced by through holes 20*h*. Specifically, the step of forming the channels (not shown in this figure) may further include etching the first plate 20B to form a plurality of through holes 20*h* for exposing the insulation blocks 116*a* on the bonding pads 632, 634. Specifically, the etching stop layer 214 may be patterned to expose portions of the substrate 204 directly above the bonding pads 632, 634, and then, the portions of the substrate 204 are etched to form the through holes 20*h* in the first plate 20B. After that, a plurality of through vias 638 are respectively formed in the through holes 20*h* and penetrate through the first plate 20B, thereby forming the air pulse generating element 600B, in which each of the through vias 638 contacts one of the bonding pads 632, 634. With this design, the actuators 106 can be electrically connected to the outside electronics by the through vias 638. For example, each of the through vias 638 may include an interconnect 638*a* penetrating through the first plate 20B and a conductive ball 638*b* for contacting the interconnect 638*a* and the bonding pad 632 or 634. In some embodiments, the through vias 638 may be formed in the second plate 30 and penetrate through the second plate 30 to contact the corresponding bonding pad 632 or 634 or the corresponding connecting block 602*c*.

Figure 32:
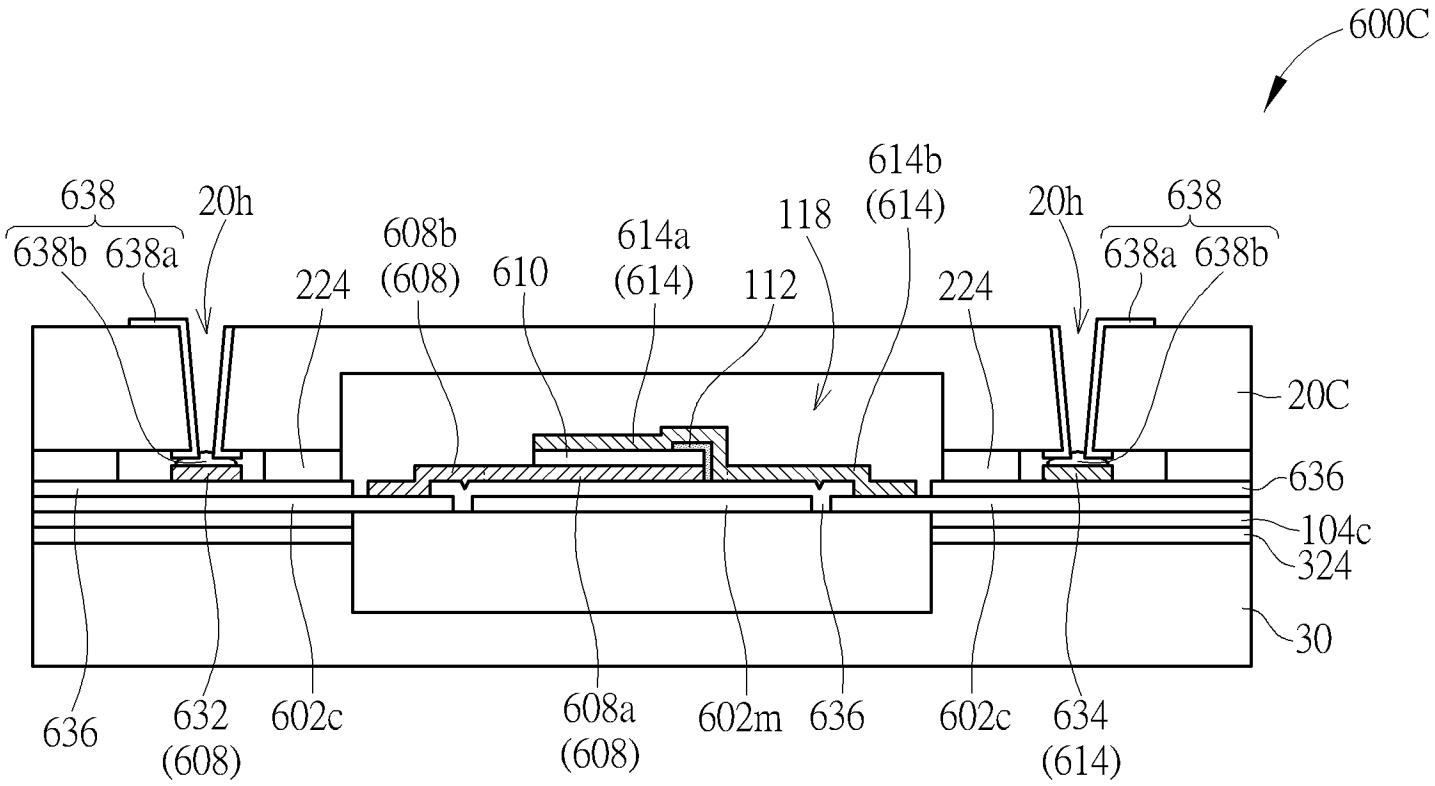
FIG. 32 schematically illustrates a sectional view of an air pulse generating element according to another variant embodiment of the fourth embodiment of the present invention.

FIG. 32 schematically illustrates a sectional view of an air pulse generating element according to another variant embodiment of the fourth embodiment of the present invention. As shown in FIG. 32, the difference between the air pulse generating element 600C and the previous variant embodiment is that the first plate 20C of this variant embodiment may be other kind of substrate instead of the semiconductor wafer. For example, the first plate 20C may include a circuit board, such as a print circuit board (PCB), or an integrated circuit (IC) chip.

Figure 33:
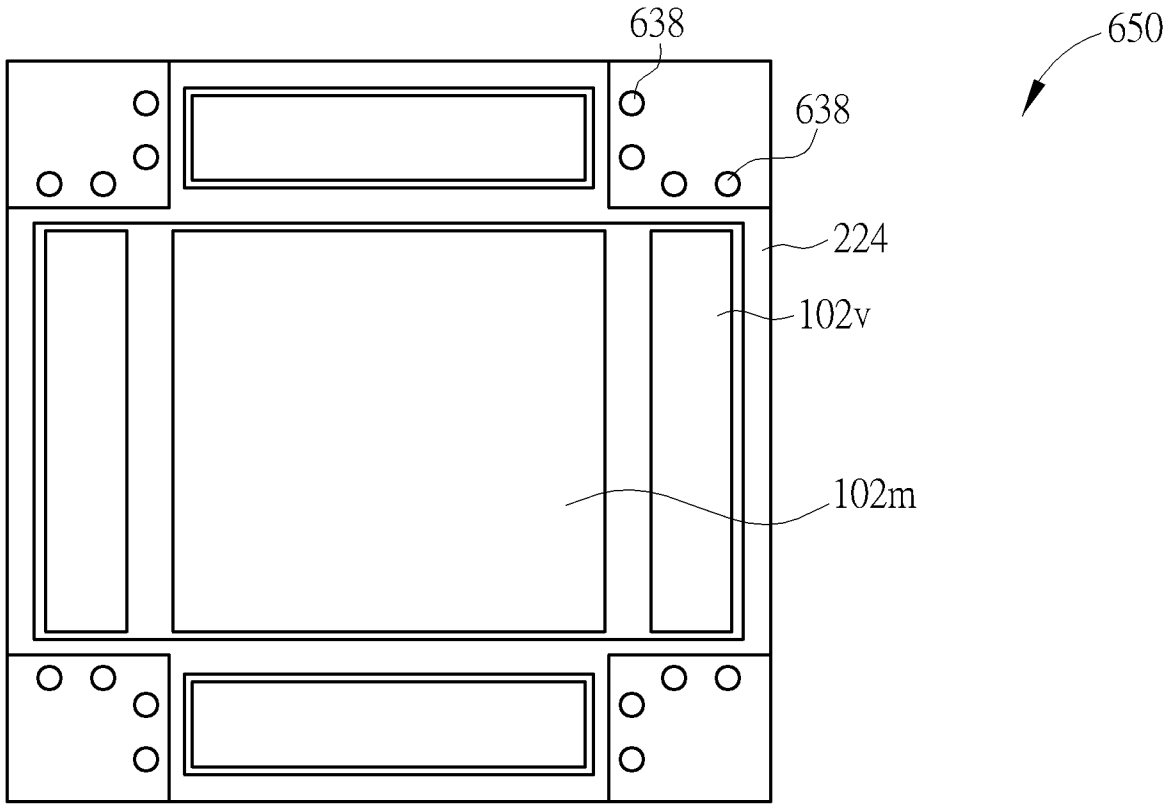
FIG. 33 schematically illustrates a top view of an air pulse generating element according to a variant embodiment of the fourth embodiment of the present invention.
Figure 34:
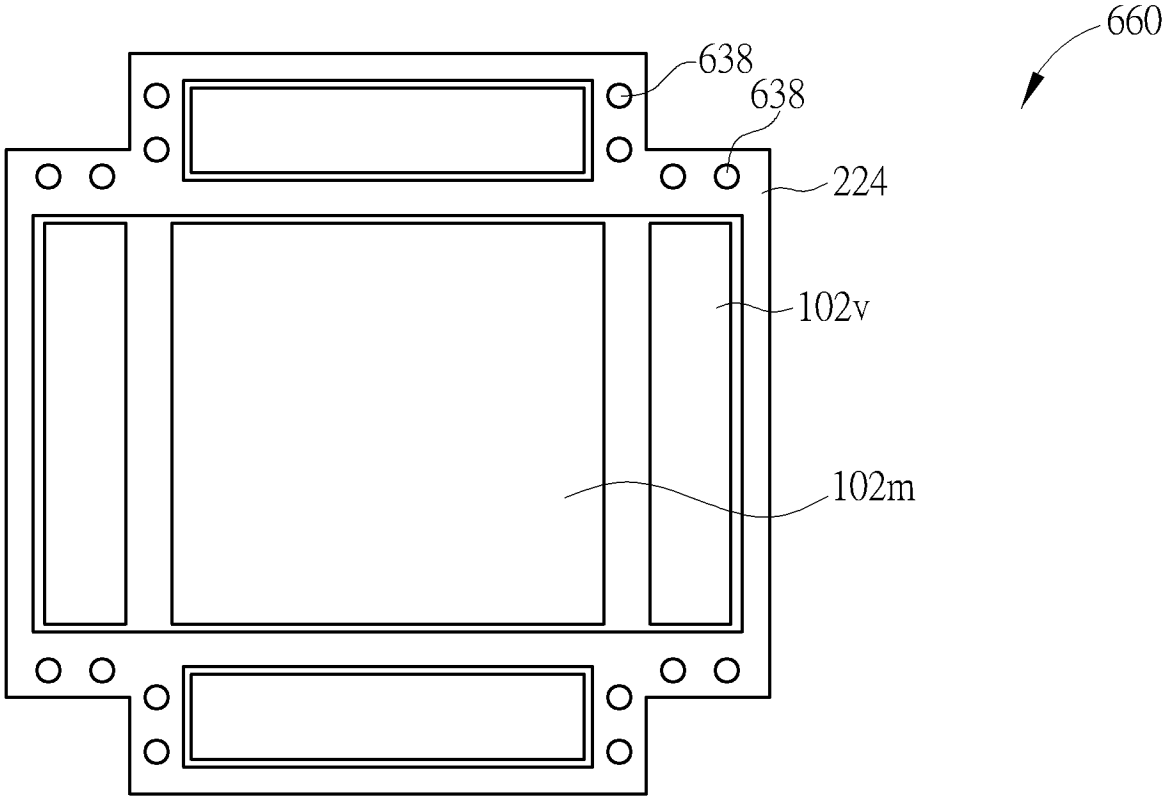
FIG. 34 schematically illustrates a top view of an air pulse generating element according to another variant embodiment of the fourth embodiment of the present invention.

FIG. 33 schematically illustrates a top view of an air pulse generating element according to a variant embodiment of the fourth embodiment of the present invention. As shown in FIG. 33, the difference between the air pulse generating element 650 of this variant embodiment and the first embodiment of FIG. 11 is that the through vias 638 of this embodiment may be disposed outside the first bonding agent 224 in the top view. For example, the through vias 638 may be disposed on two sides of each valve 102*v*. Since the through vias 638 can be disposed near the first bonding agent 224, there is no need to design an area for the bonding pads outside the first bonding agent 224, and the area of the air pulse generating element 650 can be reduced compared to the first embodiment shown in FIG. 11. In the air pulse generating element 660 of another variant embodiment of the fourth embodiment, as shown in FIG. 34, the through vias 638 may be surrounded by the first bonding agent 224 in the top view.

Figure 35:
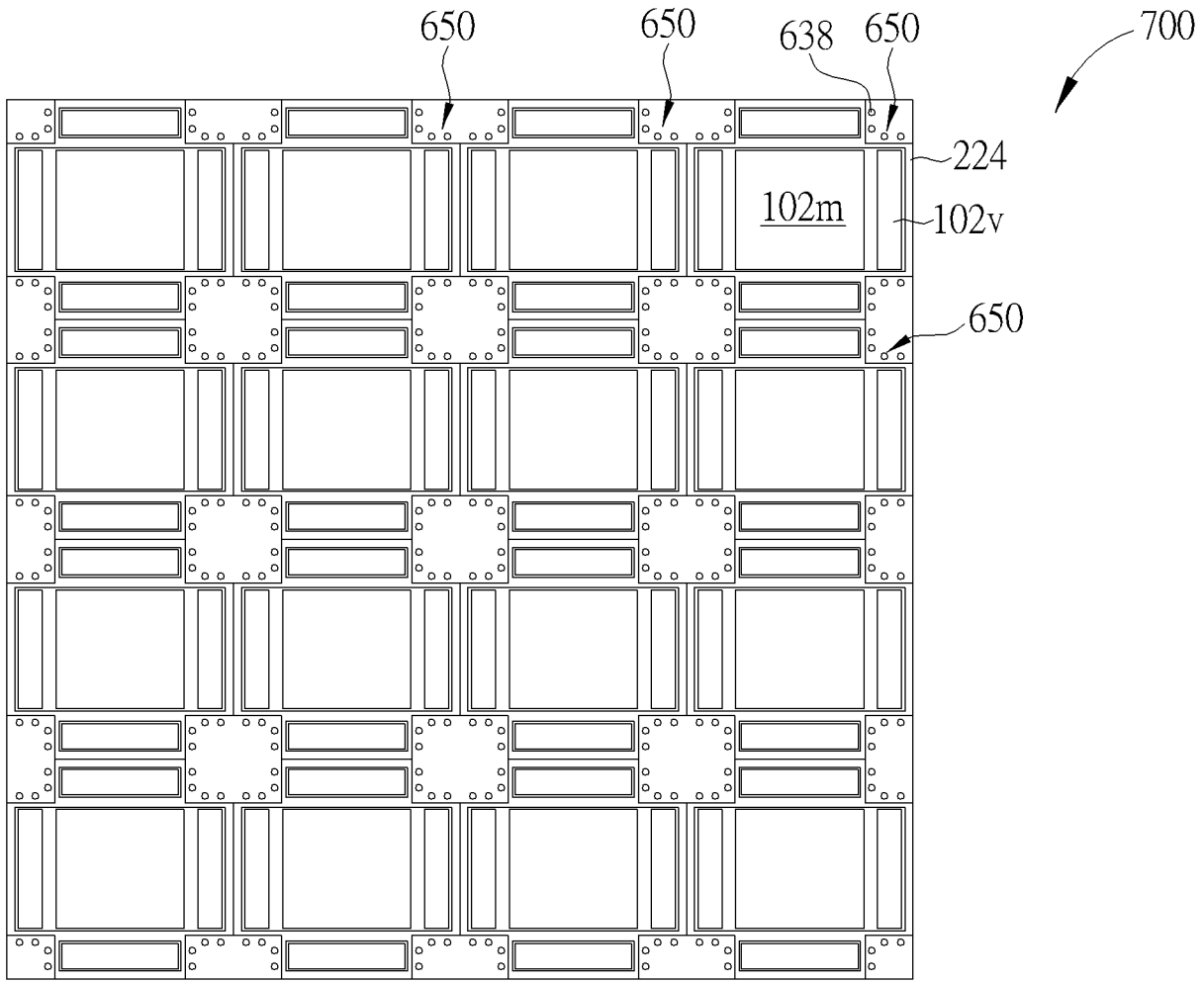
FIG. 35 schematically illustrate a sound producing device according to a fifth embodiment of the present invention.

FIG. 35 schematically illustrate a sound producing device according to a fifth embodiment of the present invention. The sound producing device 700 includes a plurality of air pulse generating elements 650. Since the through vias 638 may be surrounded by the first bonding agent 224 in the top view, and no area for the bonding pads is required on a side of the first bonding agent 224, the air pulse generating elements 650 can be arranged in an array formation. As compared with the sound producing device including the air pulse generating elements of the first embodiment, the air pulse generating elements 650 of the sound producing device 700 are not limited to be arranged in two rows or less or two columns or less. For example, the number of the columns of the array may be 3 or more, and the number of the rows of the array may also be 3 or more. Accordingly, the arrangement of the air pulse generating elements 650 can be a real two-dimensional array, and the number of the air pulse generating elements 650 of the sound producing device 700 within a certain square area can be increased. In some embodiments, each air pulse generating element 650 may be replaced by the air pulse generating element 660 shown in FIG. 34.

In summary, in the method for manufacturing the air pulse generating element of the present invention, the valves and the membrane are coplanar and formed of the same layer, which reduces manufacturing complexity and increasing the yield rate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for manufacturing an air pulse generating element, comprising:

providing a thin film layer, wherein the thin film layer comprises a membrane;

forming a plurality of actuators on the thin film layer;

forming a first chamber between the thin film layer and a first plate, wherein forming the first chamber comprises bonding the first plate on a first surface of the thin film layer through a first bonding agent;

patterning the thin film layer to form a plurality of valves, wherein the membrane and the valves are formed of the thin film layer;

forming a second chamber between the thin film layer and a second plate, wherein forming the second chamber comprises bonding the second plate on a second surface of the thin film layer opposite to the first surface through a second bonding agent; and forming a plurality of channels in the first plate and the second plate.

2. The method for manufacturing the air pulse generating element according to claim 1, wherein forming the actuators comprises forming a plurality of first electrodes, forming a plurality of deformable blocks and forming a plurality of second electrodes, and the deformable blocks are formed by patterning a same deformable layer.

3. The method for manufacturing the air pulse generating element according to claim 2, wherein the deformable layer is deformed by a piezoelectric force, an electrostatic force, an electromagnetic force or an electrothermal force.

4. The method for manufacturing the air pulse generating element according to claim 2, wherein the deformable blocks electrically insulate the first electrodes from the second electrodes.

5. The method for manufacturing the air pulse generating element according to claim 1, wherein forming the actuators comprises forming a membrane actuator on the membrane and forming a plurality of valve actuators on the valves respectively.

6. The method for manufacturing the air pulse generating element according to claim 1, wherein the first bonding agent is formed on the first plate before bonding the first plate on the first surface.

7. The method for manufacturing the air pulse generating element according to claim 1, wherein the first bonding agent is formed on the thin film layer before bonding the first plate on the first surface.

8. The method for manufacturing the air pulse generating element according to claim 7, wherein patterning the thin film layer comprises forming at least one opening in the membrane, and the first bonding agent covers the at least one opening.

9. The method for manufacturing the air pulse generating element according to claim 1, wherein providing the thin film layer further comprises providing a support substrate and a protection layer, the protection layer and the thin film layer being sequentially stacked on the support substrate, and the support substrate is removed after forming the first chamber.

10. The method for manufacturing the air pulse generating element according to claim 9, further comprising patterning the protection layer to form a protection block on one of the valves corresponding to one of the channels.

11. The method for manufacturing the air pulse generating element according to claim 10, further comprising forming an insulation block on the one of the valves before forming the first chamber, wherein the one of the valves is disposed between the protection block and the insulation block.

12. The method for manufacturing the air pulse generating element according to claim 1, further comprising patterning the thin film layer to form at least one opening in the membrane between providing the thin film layer and forming the actuators, and forming an elastic layer to cover the at least one opening between forming the at least one opening and forming the first chamber.

13. The method for manufacturing the air pulse generating element according to claim 1, further comprising forming an elastic layer on the membrane before forming the first chamber and patterning the thin film layer further comprises forming at least one opening corresponding the elastic layer in the membrane.

14. The method for manufacturing the air pulse generating element according to claim 1, further comprising patterning the thin film layer to form a plurality of traces and the membrane between providing the thin film layer and forming the actuators and forming an insulation layer for insulating the traces and the membrane from one another.

15. The method for manufacturing the air pulse generating element according to claim 14, wherein forming the actuators further comprises forming a plurality of bonding pads, and the actuators are electrically connected to the bonding pads through the traces.

16. The method for manufacturing the air pulse generating element according to claim 1, wherein forming the actuators further comprises forming a plurality of bonding pads on the thin film layer, and the method further comprises:

forming a plurality of through vias to penetrate through one of the first plate and the second plate, the through vias being electrically connected to the bonding pads.

17. The method for manufacturing the air pulse generating element according to claim 1, wherein before forming the first chamber, the method further comprises:

providing a substrate; and forming at least two recesses with different depths on a surface of the substrate to form the first plate.

18. The method for manufacturing the air pulse generating element according to claim 17, further comprising forming a protrusion in one of the recesses, wherein the protrusion surrounds one of the channels.

19. The method for manufacturing the air pulse generating element according to claim 1, wherein the first plate comprises a semiconductor substrate, a printed circuit board or an integrated circuit chip.

* * * * *